US005336591A

United States Patent [19]

Yamamoto et al.

[11] Patent Number: 5,336,591

[45] Date of Patent: * Aug. 9, 1994

[54] SILVER HALIDE COLOR PHOTOGRAPHIC MATERIAL

[75] Inventors: Mitsuru Yamamoto; Akira Ogawa, both of Kanagawa, Japan

[73] Assignee: Fuji Photo Film Co., Ltd., Kanagawa, Japan

[ * ] Notice: The portion of the term of this patent subsequent to May 25, 2010 has been disclaimed.

[21] Appl. No.: 845,589

[22] Filed: Mar. 4, 1992

[30] Foreign Application Priority Data

Mar. 5, 1991 [JP] Japan ..... 3-62433

[51] Int. Cl.[5] ..... G03C 7/36

[52] U.S. Cl. ..... 430/549; 430/556; 430/557; 430/558

[58] Field of Search ..... 430/549, 556, 557, 558

[56] References Cited

U.S. PATENT DOCUMENTS

| | | | |
|---|---|---|---|
| 4,149,886 | 4/1979 | Tanaka et al. | 430/557 |
| 4,579,816 | 4/1986 | Ohlschlager et al. | 430/544 |
| 5,006,452 | 4/1991 | Bucci | 430/544 |
| 5,070,003 | 12/1991 | Naruse et al. | 430/389 |
| 5,213,958 | 5/1993 | Motoki et al. | 430/558 |

FOREIGN PATENT DOCUMENTS

| | | |
|---|---|---|
| 0447920 | 9/1991 | European Pat. Off. . |
| 1204680 | 9/1970 | United Kingdom . |

*Primary Examiner*—Lee C. Wright

*Attorney, Agent, or Firm*—Birch, Stewart, Kolasch & Birch

[57] ABSTRACT

A silver halide color photographic material comprising a support having thereon at least one blue-sensitive silver halide emulsion layer, wherein said blue-sensitive silver halide emulsion layer contains at least one yellow dye forming coupler represented by the following general formula (1) or (2), and at least one yellow dye forming coupler represented by the following general formula (F):

(1)

(2)

wherein $X_1$ and $X_2$ each represents an alkyl group, an aryl group or a heterocyclic group; $X_3$ represents an organic residue which forms a nitrogen-containing heterocyclic group together with >N—; Y represents an aryl group or a heterocyclic group; and Z represents a group which is capable of being released when the coupler of general formula (1) or (2) reacts with an oxidation product of a developing agent;

(F)

wherein $R_{20}$ represents a tertiary alkyl group; $R_{21}$ represents a hydrogen atom, a halogen atom, an alkoxy group, an aryloxy group, an alkyl group or a dialkylamino group; $R_{22}$ represents a substituent group capable of being attached to the benzene ring; Z represents a hydrogen atom or a releasing group which is capable of being released by the coupling reaction with an oxidation product of an aromatic primary amine developing agent; and k represents an integer of 0 to 4, and when k is 2 or greater, two or more $R_{22}$ groups may be the same or different.

10 Claims, No Drawings

SILVER HALIDE COLOR PHOTOGRAPHIC MATERIAL

FIELD OF THE INVENTION

The present invention relates to a silver halide color photographic material which is excellent in graininess and dye image preservability.

BACKGROUND OF THE INVENTION

With the development of color photographic materials, an increase in photographic speed and an improvement in image quality have been made in recent years to meet the needs of users. With regard to the demand of higher image quality, improvements in color reproducibility, sharpness and graininess have mainly been made. These improvements are very important factors for the performance of light-sensitive materials, and further improvements are demanded.

Developed dyes formed by yellow, magenta and cyan couplers used in conventional silver halide color photographic materials have undesirable secondary absorption, and hence color reproducibility may be deteriorated. Accordingly, studies have been made to develop couplers which produce a dye image having less secondary absorption to improve color reproducibility.

Developed dyes formed from conventional yellow couplers have low chroma. Accordingly, it has been highly demanded to improve yellow dyes by sharpening spectral absorption. Further, there is a problem that yellow dye images fade depending on the preservation conditions and particularly due to the moisture and temperature conditions. It has been highly demanded to solve the problem mentioned above.

SUMMARY OF THE INVENTION

Therefore, an object of the present invention is to provide a color photographic material which is excellent in graininess.

Another object of the present invention is to provide a color photographic material which is excellent in dye image preservability.

The above-described objects of the present invention have been achieved by providing a silver halide color photographic material comprising a support having thereon at least one blue-sensitive silver halide emulsion layer, wherein said blue-sensitive silver halide emulsion layer contains at least one yellow dye forming coupler represented by the following general formula (1) or (2) and at least one yellow dye forming coupler represented by the following general formula (F):

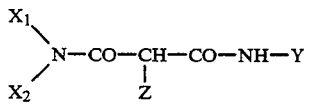

(1)

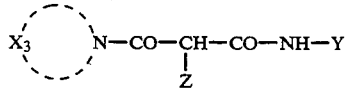

(2)

wherein $X_1$ and $X_2$ each represents an alkyl group, an aryl group or a heterocyclic group; $X_3$ represents an organic residue which forms a nitrogen-containing heterocyclic group together with >N—; Y represents an aryl group or a heterocyclic group; and Z represents a group capable of being released when the coupler represented by general formula (1) or (2) reacts with an oxidation product of a developing agent;

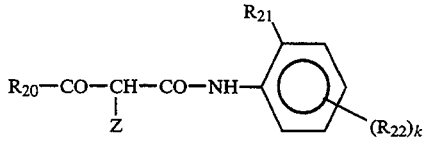

(F)

wherein $R_{20}$ represents a tertiary alkyl group; $R_{21}$ represents a hydrogen atom, a halogen atom, an alkoxy group, an aryloxy group, an alkyl group or a dialkylamino group; $R_{22}$ represents a group capable of being substituted on the benzene ring; Z represents a hydrogen atom or a releasable group which is capable of being released by the coupling reaction with an oxidation product of an aromatic primary amine developing agent; and k represents an integer of 0 to 4, and when k is 2 or greater, two or more $R_{22}$ groups may be the same or different.

DETAILED DESCRIPTION OF THE INVENTION

The couplers represented by general formulas (1) and (2) are illustrated in more detail below.

The alkyl group represented by $X_1$ and $X_2$ is a straight-chain, branched or cyclic, saturated or unsaturated, substituted or unsubstituted alkyl group having 1 to 30 carbon atoms, preferably 1 to 20 carbon atoms. Examples of the alkyl group include methyl, ethyl, propyl, butyl, cyclopropyl, allyl, t-octyl, i-butyl, dodecyl and 2-hexyldecyl.

The heterocyclic group represented by $X_1$ and $X_2$is a 3-membered to 12-membered, preferably 5-membered or 6-membered, saturated or unsaturated, substituted or unsubstituted, monocyclic or condensed-ring heterocyclic group having 1 to 20 carbon atoms, preferably 1 to 10 carbon atoms, and at least one hetero-atom is a nitrogen atom, an oxygen atom or a sulfur atom. Examples of the heterocyclic group include 3-pyrrolidinyl, 1,2,4-triazol-3-yl, 2-pyridyl, 4-pyrimidinyl, 3-pyrazolyl, 2-pyrrolyl, 2,4-dioxo-1,3-imidazolidin-5-yl and pyranyl.

The aryl group represented by $X_1$ and $X_2$ is a substituted or unsubstituted aryl group having 6 to 20 carbon atoms, preferably 6 to 10 carbon atoms. Typical examples of the aryl group include phenyl and naphthyl.

When $X_3$ together with >N- forms a nitrogen containing heterocyclic group, the heterocyclic group is a 3- to 12-membered, preferably 5- to 6-membered, substituted or unsubstituted, saturated or unsaturated, monocyclic or condensed ring heterocyclic group having 1 to 20 carbon atoms, preferably 1 to 15 carbon atoms. The heterocyclic group may contain another hetero-atom such as an oxygen atom or a sulfur atom in addition to the nitrogen atom. Examples of the heterocyclic group include pyrrolidino, piperidino, morpholino, 1piperazinyl, 1-indolinyl, 1,2,3,4-tetrahydroquinolin-1-yl, 1-imidazolidinyl, 1-pyrazolyl, 1-pyrrolinyl, pyrazolidinyl, 2,3-dihydro-l-indazolyl, 2-isoindolinyl, 1-indolyl, 1-pyrrolyl, 4-thiazine-S,S-dioxo-4-yl and benzoxazin-4-yl.

The alkyl group, the aryl group and the heterocyclic group represented by $X_1$ and $X_2$ may be substituted. The nitrogen-containing heterocyclic group formed by $X_3$together with >N— may be substituted. Examples of such substituent groups include a halogen atom ( e. g., fluorine and chlorine atoms), an alkoxycarbonyl group (having 2 to 30 carbon atoms, preferably 2 to 20 carbon atoms, such as methoxycarbonyl, dodecyloxycarbonyl, hexadecyloxycarbonyl ), an acylamino group (having 2 to 30 carbon atoms, preferably 2 to 20 carbon atoms, such as acetamido, tetradecaneami do, 2-( 2,4-di-t-amylphenoxy)butaneamido, benzamido), a sulfonamido group (having 1 to 30 carbon atoms, preferably 1 to 20 carbon atoms, such as methanesulfonamido, dodecanesulfonamido, hexadecylsulfonamido, benzenesulfonamido ), a carbamoyl group (having 1 to 30 carbon atoms, preferably 1 to 20 carbon atoms, such as N-butylcarbamoyl, N,N-diethylcarbamoyl an N-sulfonylcarbamoyl group (having 1 to 30 carbon atoms, preferably 1 to 20 carbon atoms, such as N-mesylcarbamoyl, N-dodecylsulfonylcarbamoyl), a sulfamoyl group (having 1 to 30 carbon atoms, preferably 1 to 20 carbon atoms, such as N-butylsulfamoyl, N-dodecylsulfamoyl, N-hexadecylsulfamoyl, N-3-( 2,4-di-t-amylphenoxy butylsulfamoyl, N,N-diethylsulfamoyl ), an alkoxy group (having 1 to 30 carbon atoms, preferably 1 to 20 carbon atoms, such as methoxy, hexadecyloxy, isopropoxy), an aryloxy group (having 6 to 20 carbon atoms, preferably 6 to 10 carbon atoms, such as phenoxy, 4-methoxyphenoxy, 3-t-butyl-4-hydroxyphenoxY, naphthoxy ), an aryloxycarbonyl group (having 7 to 21 carbon atoms, preferably 7 to 11 carbon atoms, such as phenoxycarbonyl), an N-acylsulfamoyl group (having 2 to 30 carbon atoms, preferably 2 to 20 carbon atoms, such as N-propanoylsulfamoyl, N-tetradecanoylsulfamoyl ), a sulfonyl group (having 1 to 30 carbon atoms, preferably 1 to 20 carbon atoms, such as methanesulfonyl, octanesulfonyl, 4-hydroxyphenylsulfonyl, dodecanesulfonyl), an alkoxycarbonylamino group (having 1 to 30 carbon atoms, preferably 1 to 20 carbon atoms, such as ethoxycarbonylamino), a cyano group, a nitro group, a carboxyl group, a hydroxyl group, a sulfo group, an alkylthio group (having 1 to 30 carbon atoms, preferably 1 to 20 carbon atoms, such as methylthio, dodecylthio, dodecylcarbamoylmethylthio), a ureido group (having 1 to 30 carbon atoms, preferably 1 to 20 carbon atoms, such as N-phenylureido, N-hexadecylureido), an aryl group (having 6 to 20 carbon atoms, preferably 6 to 10 carbon atoms, such as phenyl, naphthyl, 4-methoxyphenyl ), a heterocyclic group (e.g., a 3- to 12-membered, preferably 5- or 6-membered monocyclic ring or condensed ring having 1 to 20 carbon atoms, preferably 1 to 10 carbon atoms, and containing at least one hereto-atom such as a nitrogen atom, an oxygen atom or a sulfur atom, such as 2-pyridyl, 3-pyrazolyl, 1-pyrrolyl, 2,4-dioxo-l,3-imidazolidin-1-yl, 2-benzoxazolyl, morpholino, indo alkyl group (e.g., a straight-chain, branched or cyclic saturated or unsaturated alkyl group having 1 to 30 carbon atoms, preferably 1 to 20 carbon atoms, such as methyl, ethyl, isopropyl, cyclopropyl, t-pentyl, t-octyl, cyclopentyl, t-butyl, s-butyl, dodecyl, 2-hexyldecyl), an acyl group (having 1 to 30 carbon atoms, preferably 2 to 20 carbon atoms, such as acetyl, benzoyl), an acyloxy group (having 2 to 30 carbon atoms, preferably 2 to 20 carbon atoms, such as propanoyloxy, tetradecanoyloxy), an arylthio group (having 6 to 20 carbon atoms, preferably 6 to 10 carbon atoms, such as phenylthio, naphthylthio), a sulfamoylamino group (having 0 to 30 carbon atoms, preferably 0 to 20 carbon atoms, such as N-butylsulfamoylamino, N-dodecylsulfamoylamino, N-phenylsulfamoylamino ), and an N-sulfonylsulfamoyl group (having 1 to 30 carbon atoms, preferably 1 to 20 carbon atoms, such as N-mesylsulfamoyl, N-ethanesulfonylsulfamoyl, N-dodecanesulfonylsulfamoyl, N-hexadecanesulfonylsulfamoyl ). These substituent groups may be further substituted. Examples of such substituent groups include those described above in the definition of the substituent groups for $X_1$, $X_2$and the nitrogen-containing heterocyclic group. Among them, the preferred substituent groups include an alkoxy group, a halogen atom, an alkoxycarbonyl group, an acyloxy group, an acylamiho group, a sulfonyl group, a carbamoyl group, a sulfamoyl group, a sulfonamido group, a nitro group, an alkyl group and an aryl group.

The aryl group represented by Y in general formulas (1) and (2) is a substituted or unsubstituted aryl group having 6 to 20 carbon atoms, preferably 6 to 10 carbon atoms. Typical examples of the aryl group include a phenyl group and a naphthyl group.

The heterocyclic group represented by Y in general formulas (1) and (2) has the same meaning as $X_1$and $X_2$.

The aryl group and the heterocyclic group represented by Y may be substituted. Examples of such substituent groups include those described above in the definition of the substituent groups for $X_1$. Preferred examples of the substituent groups for Y include those in which one substituent group for Y is a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group or an alkyl group.

Particularly preferably, Y is a phenyl group having at least one substituent group at the ortho-position.

The group represented by Z in general formulas (1) and ( 2 ) may be any of the conventional groups which are released by coupling. Preferred examples of Z include a nitrogen-containing heterocyclic group which is bonded at the coupling position through a nitrogen atom, an aryloxy group, an arylthio group, a heterocyclic oxy group, a heterocyclic thio group, an acyloxy group, a carbamoyloxy group, an alkylthio group and a halogen atom.

These releasing groups may be any of a non-photographically useful group, a photographically useful group and a precursor thereof (e.g., a development inhibitor, a development accelerator, a desilverization accelerator, a fogging agent, a dye, a hardening agent, a coupler, a scavenger for the oxidation product of a developing agent, a fluorescent dye, a developing agent or an electron transfer agent).

When Z is a photographically useful group, any of the conventional photographically useful groups are useful in the present invention. Examples of such groups include photographically useful groups and split-off groups (e.g., timing groups ) which release a photographically useful group as described in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571 and 4,741,994, European Patent Publication Nos. 193389A, 348139A and 272573A.

When Z is a nitrogen-containing heterocyclic group which is bonded at the coupling position through a nitrogen atom, Z is preferably a 5- or 6-membered, substituted or unsubstituted, saturated or unsaturated, monocyclic or condensed ring heterocyclic group having 1 to 15 carbon atoms, preferably 1 to 10 carbon atoms. The heterocyclic ring may have another heteroatom such as an oxygen atom or a sulfur atom in addition to the nitrogen atom. Preferred examples of the heterocyclic group include 1-pyrazolyl, 1-imidazolyl, pyrrolino, 1,2,4-triazol-2-yl, 1,2,4-triazol-l-yl, benztriazolyl, benzimidazolyl, imidazolidine-2,4-dione-3-yl, oxazolidine-2,4-dione-3-yl, 1,2,4-triazolidine-3,5-dione-4-yl, imidazolidine-2,4,5-trione-3-yl, 2-imidazolinon-1-yl, 3,5-dioxomorpholino and 1-indazolyl. These heterocyclic groups may be substituted. Examples of such substituent groups include those described above in the definition of the substituent groups for $X_1$. When the group has one or more substituent groups, preferably one of the substituent groups is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, a cyano group or a sulfonyl group.

The aromatic oxy group represented by Z is preferably a substituted or unsubstituted aromatic oxy group having 6 to 10 carbon atoms. Particularly preferably, Z is a substituted or unsubstituted phenoxy. Examples of the substituent groups include those described above in the definition of the substituent groups for $X_1$. When the group has one or more substituent groups, preferably at least one of the substituent groups is an electron attractive group. Examples of such substituent groups include a sulfonyl group, an alkoxycarbonyl, a sulfamoyl group, a halogen atom, a carbamoyl group, a nitro group, a cyano group and an acyl group.

The aromatic thio group represented by Z is preferably a substituted or unsubstituted aromatic thio group having 6 to 10 carbon atoms. Particularly preferably, Z is a substituted or unsubstituted phenylthio group. Examples of substituent groups include those described above in the definition of the substituent groups for $X_1$. When the group has one or more substituent groups, preferably at least one of the substituent groups is an alkyl group, an alkoxy group, a sulfonyl group, an alkoxycarbonyl group, a sulfamoyl group, a halogen atom, a carbamoyl group or a nitro group.

The heterocyclic oxy group represented by Z is a 3- to 12-membered, preferably 5- or 6-membered, substituted or unsubstituted, saturated or unsaturated, monocyclic or condensed ring heterocyclic group wherein the heterocyclic ring moiety has 1 to 20 carbon atoms, preferably 1 to 10 carbon atoms and at least one heteroatom is a nitrogen atom, an oxygen atom or a sulfur atom. Examples of the heterocyclic oxy group include a pyridyloxy group, a pyrazolyloxy group and a furyloxy group. Examples of substituent groups include those described above in the definition of the substituent groups for $X_1$. When the group has one or more substituent groups, preferably one of the substituent groups is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group or a sulfonyl group.

The heterocyclic thio group represented by Z is a 3- to 12-membered, preferably 5- or 6-membered, substituted or unsubstituted, saturated or unsaturated, monocyclic or condensed ring heterocyclic group where the heterocyclic ring moiety has 1 to 20 carbon atoms, preferably 1 to 10 carbon atoms and at least one heteroatom is a nitrogen atom, an oxygen atom or a sulfur atom. Examples of the heterocyclic thio group include a tetrazolylthio group, a 1,3,4-thiadiazolylthio group, a 1,3,4-oxadiazolylthio group, a 1,3,4-triazolylthio group, a benzimidazolylthio group, a benzthiazolylthio group and a 2-pyridylthio group. Examples of the substituent groups include those described above in the definition of the substituent groups for $X_1$. When the group has one or more substituent groups, preferably at least one of the substituent groups is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group or a sulfonyl group.

The acyloxy group represented by Z is preferably a substituted or unsubstituted, monocyclic or condensed ring, aromatic acyloxy group preferably having 6 to 10 carbon atoms, or a substituted or unsubstituted aliphatic acyloxy group having 2 to 30 carbon atoms, preferably 2 to 20 carbon atoms. Examples of the substituent groups include those described above in the definition of the substituent groups for $X_1$.

The carbamoyloxy group represented by Z is a substituted or unsubstituted, aliphatic, aromatic or heterocyclic carbamoyl group having 1 to 30 carbon atoms, preferably 1 to 20 carbon atoms. Examples of the carbamoyloxy group include N,N-diethylcarbamoyloxy, N-phenylcarbamoyloxy, 1-imidazolylcarbonyloxy and 1-pyrrolocarbonyloxy. Examples of the substituent groups include those described above in the definition of the substituent groups for $X_1$.

The alkylthio group represented by Z is a straight-chain, branched or cyclic, saturated or unsaturated, substituted or unsubstituted alkylthio group having 1 to 30 carbon atoms, preferably 1 to 20 carbon atoms. Examples of the substituent groups include those described above in the definition of the substituent groups for $X_1$.

Preferred examples of the couplers represented by general formulae (1) and ( 2 ) include the compounds where the group represented by $X_1$ in general formula (1) is an alkyl group, with an alkyl group having 1 to 10 carbon atoms being particularly preferred; the compounds where the group represented by Y in general formulae (1) and (2) is preferably an aromatic group with a phenyl group having at least one substituent group at the ortho-position being particularly preferred (examples of the substituent groups are those described above when Y is an aromatic group, and preferred substituent groups are as described above); and the compounds where the group represented by Z in general formulae (1) and ( 2 ) is preferably a 5- or 6-membered nitrogen-containing heterocyclic group which is bonded at the coupling position through a nitrogen atom, an aromatic oxy group, a 5- or 6-membered heterocyclic group, or a 5- or 6-membered heterocyclic thio group.

Preferred couplers represented by general formulae (1) and (2) are compounds represented by the following general formula (3), ( 4 ) or (5):

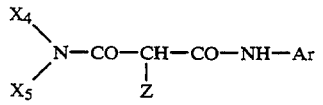

(3)

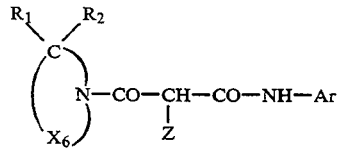

(4)

-continued (5)

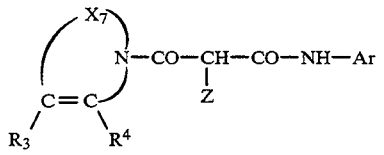

wherein Z is as defined above in general formula (1); $X_4$ represents an alkyl group; $X_5$ represents an alkyl group or an aromatic group; Ar represents a phenyl group having at least one substituent group at the ortho-position; $X_6$ represents an organic residue which forms a nitrogen-containing heterocyclic group (monocyclic ring or condensed ring) together with-$C(R_1R_2)$—N<; $X_7$ represents an organic residue which forms a nitrogen-containing heterocyclic group (monocyclic ring or condensed ring) together with —$C(R_3)$=$C(R_4)$—N<; and $R_1$, $R_2$, $R_3$ and $R_4$ each represents a hydrogen atom or a substituent group.

The details and preferred ranges of the groups represented by $X_4$ to $X_7$, Ar and Z in general formulae (3) to ( 5 ) are as described above in general formulae (1) and (2). $R_1$ to $R_4$ each may have one or more substituent groups. Examples of such substituent groups include those described above in the definition of the substituent groups for $X_1$.

Among the couplers described above, the couplers represented by general formula ( 4 ) or (5) are particularly preferred.

Each of the couplers represented by general formulae ( 1 ) to ( 5 ) may be combined together through a divalent group or a polyvalent group by the groups represented by $X_1$ to $X_7$, Y, At, $R_1$ to $R_4$ and Z to form a dimer or a polymer (e.g., a telomer or a polymer). In this case, the number of carbon atoms in each substituent group may exceed the number of carbon atoms defined above.

The couplers represented by general formulae (1) to (5) are preferably non-diffusible couplers. The term "non-diffusible coupler" as used herein refers to a coupler having a group which sufficiently increases the molecular weight thereof to make the coupler immobile in the layer to which the coupler is added. Generally, an alkyl group having 8 to 30 carbon atoms in total, preferably 10 to 20 carbon atoms in total or an aryl group having a substituent group having 4 to 20 carbon atoms in total is used as the non-diffusible group. The non-diffusible group may be located at any position of the molecule. Further, two or more non-diffusible groups may be used.

Specific examples of the yellow couplers represented by general formulae ( 1 ) to ( 5 ) are illustrated below, but the present invention is not limited to these compounds.

Y-1

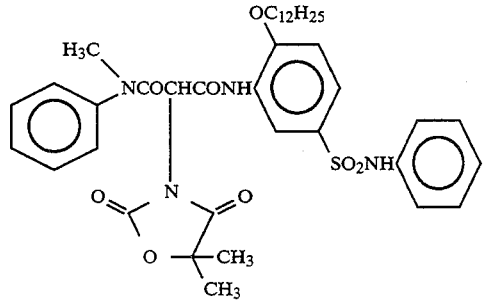

Y-2

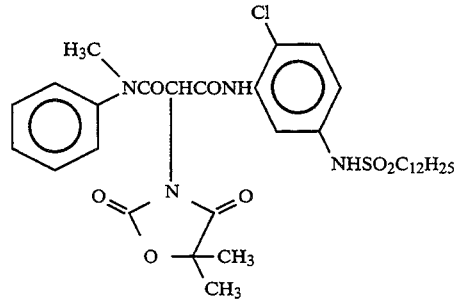

Y-3

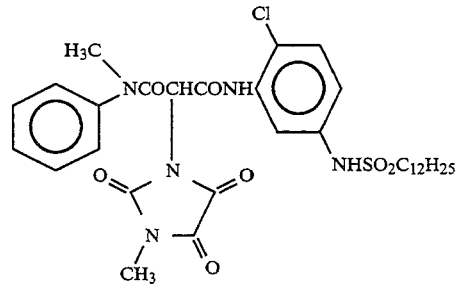

-continued
Y-4
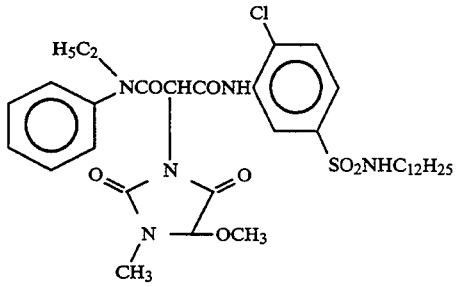
Y-5
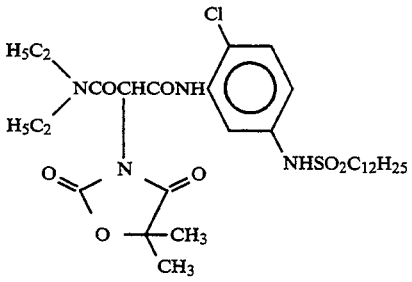
Y-6
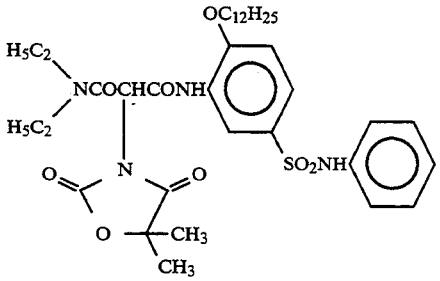
Y-7
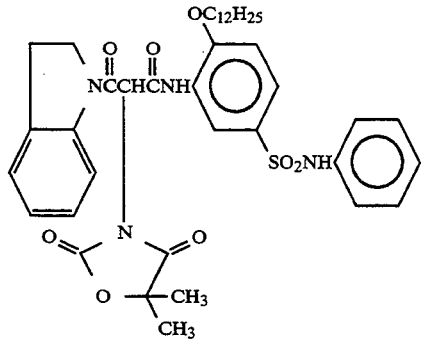
Y-8
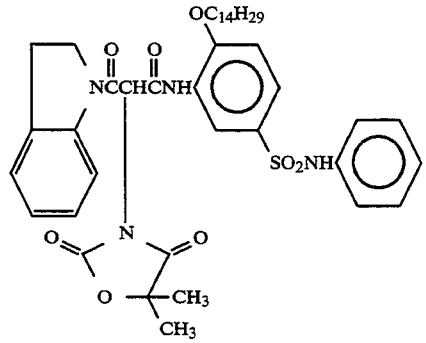

-continued
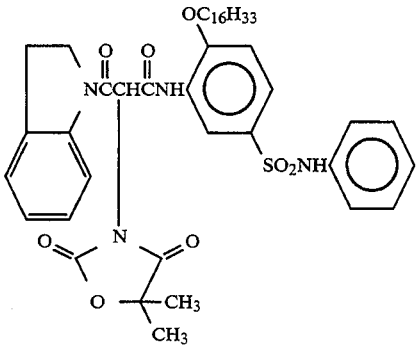
Y-9
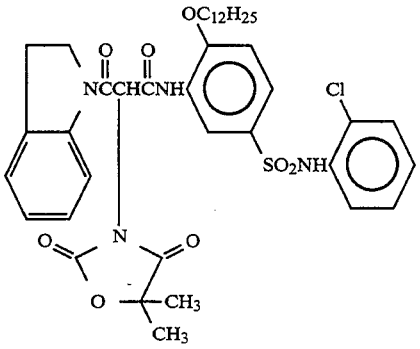
Y-10
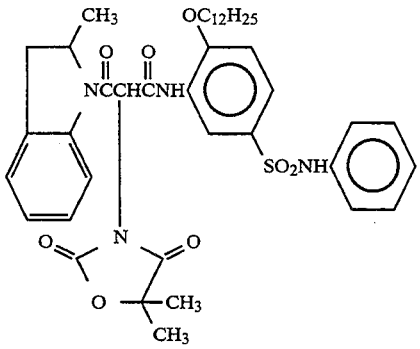
Y-11
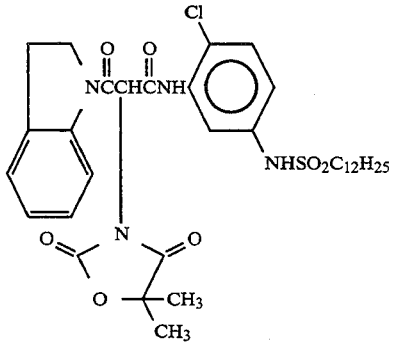
Y-12

-continued
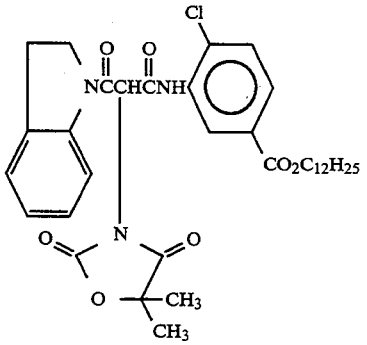
Y-13
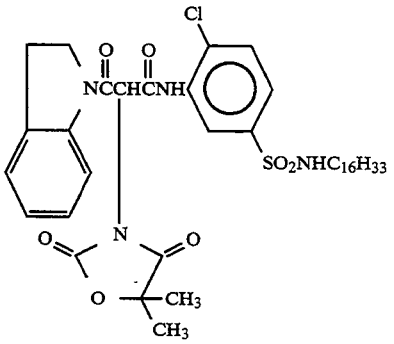
Y-14
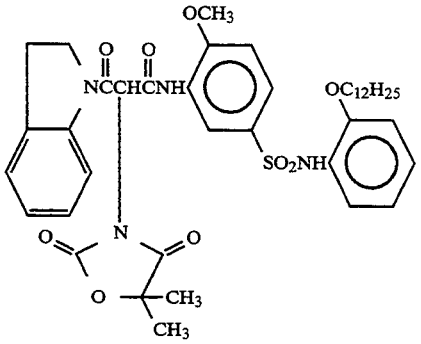
Y-15
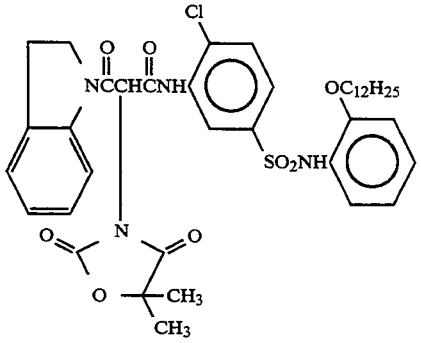
Y-16

-continued
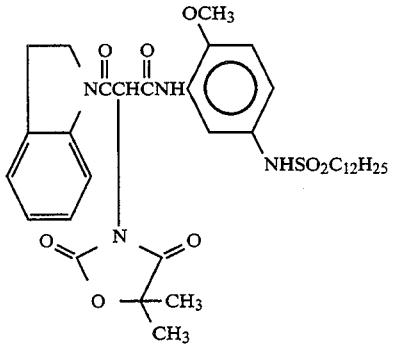
Y-17
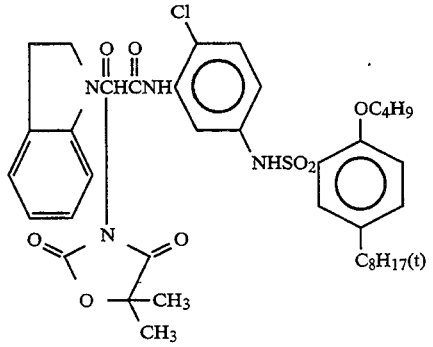
Y-18
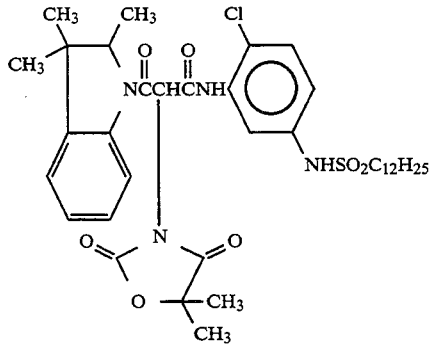
Y-19
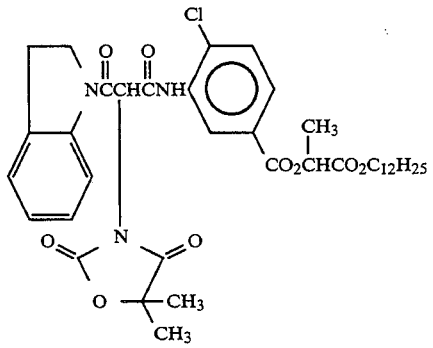
Y-20

-continued
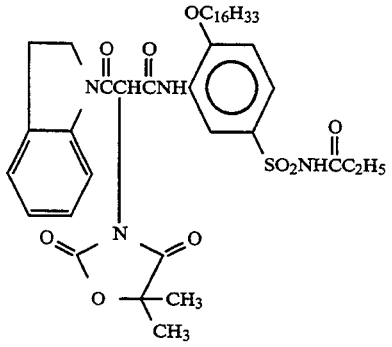
Y-21
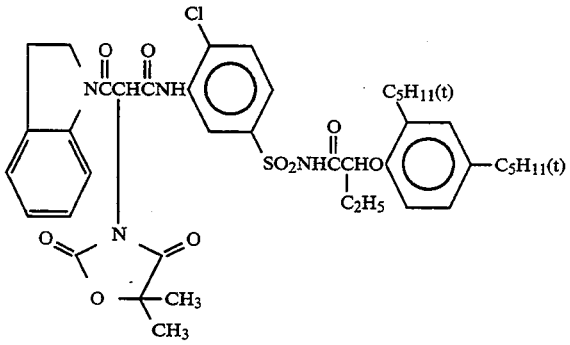
Y-22
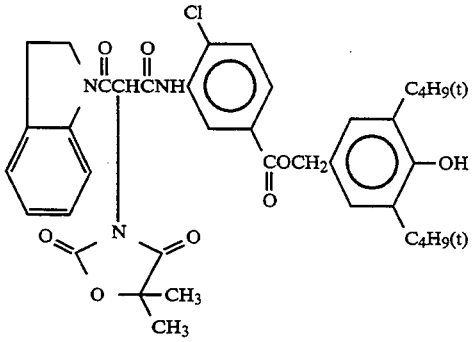
Y-23
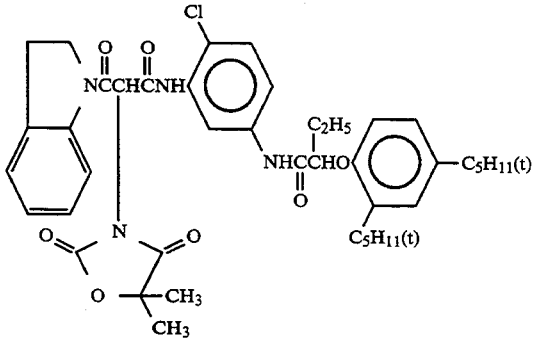
Y-24

-continued
Y-25
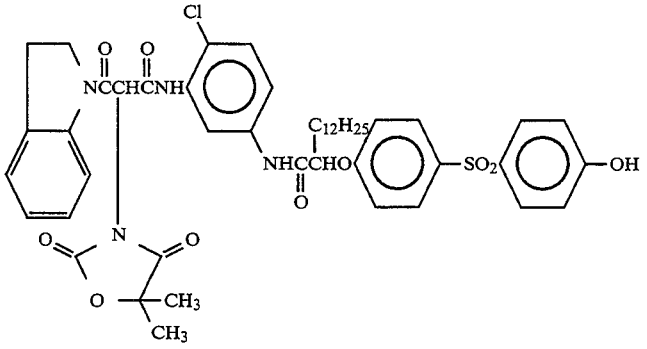
Y-26
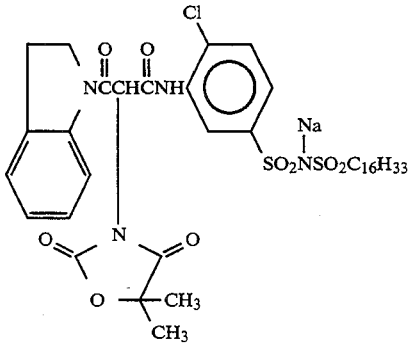
Y-27
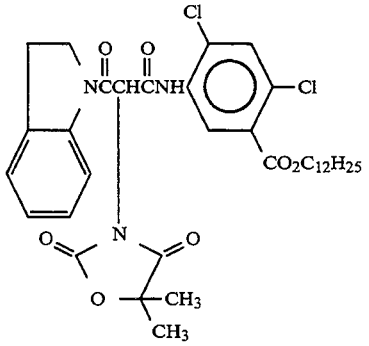
Y-28
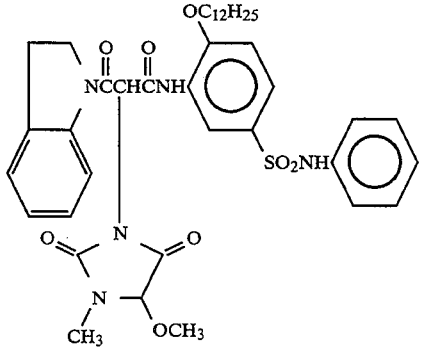

-continued
Y-29
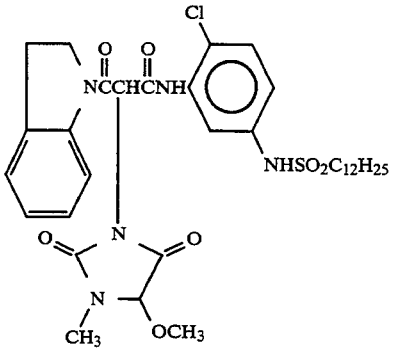
Y-30
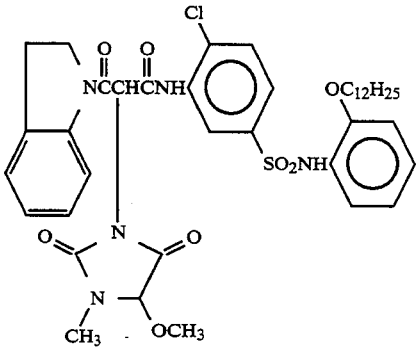
Y-31
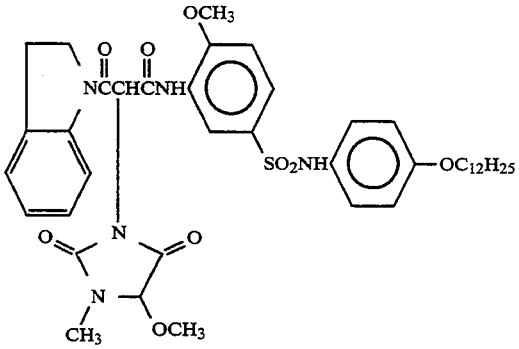
Y-32
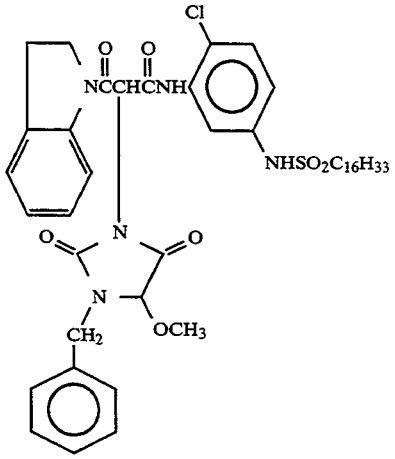

-continued
Y-33
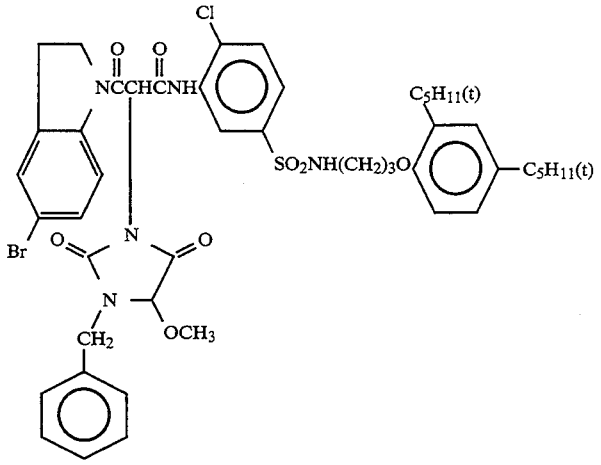
Y-34
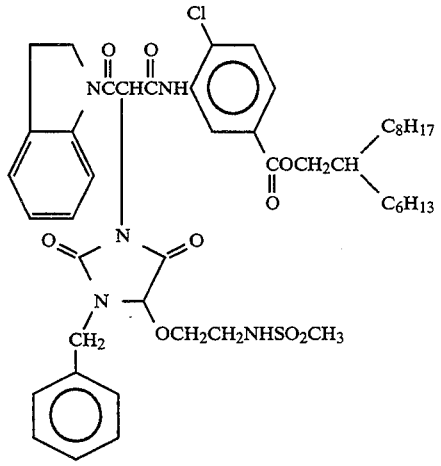
Y-35
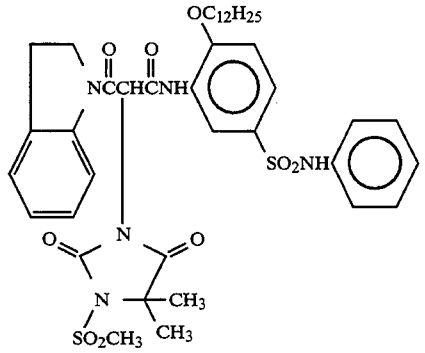
Y-36
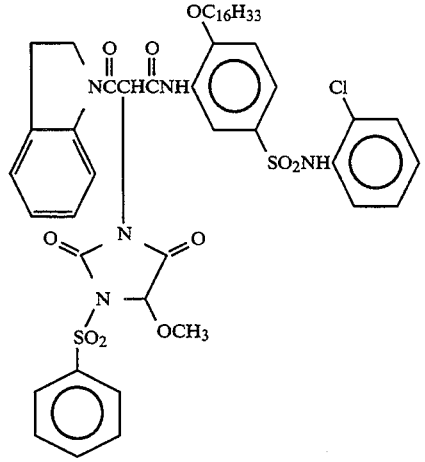

-continued
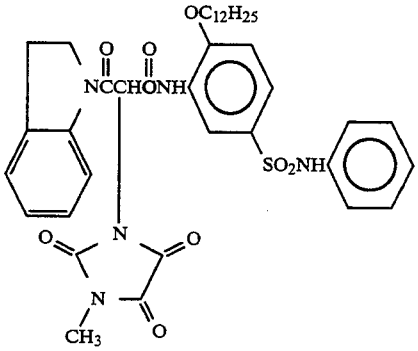
Y-37
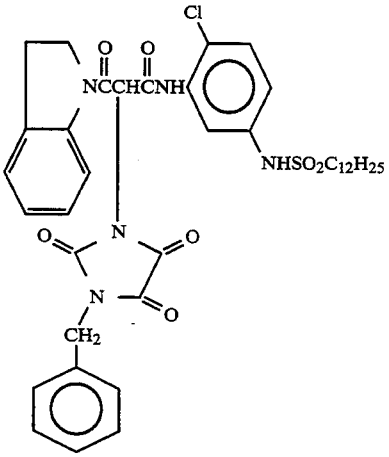
Y-38
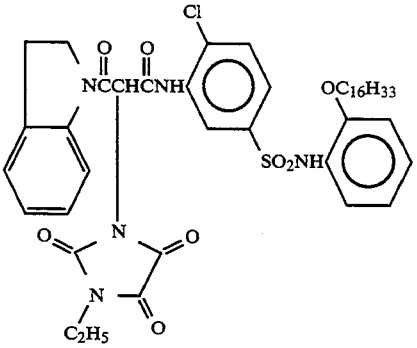
Y-39
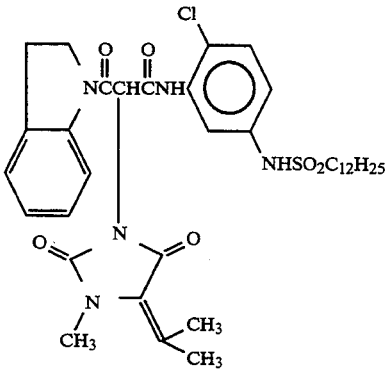
Y-40

-continued
Y-41
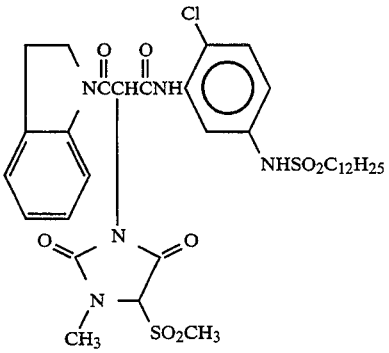
Y-42
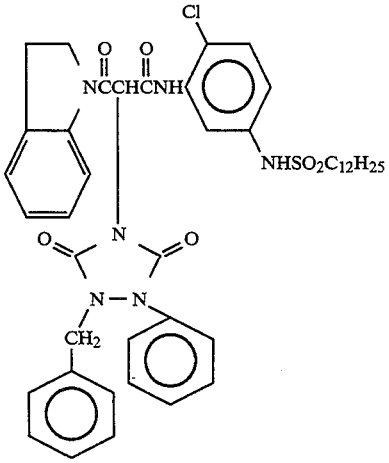
Y-43
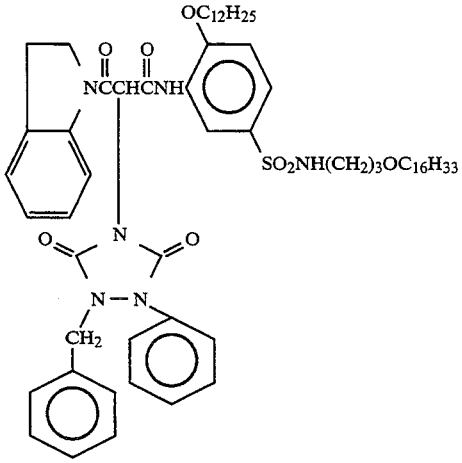
Y-44
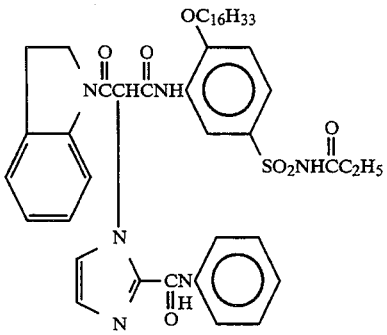

-continued
Y-45
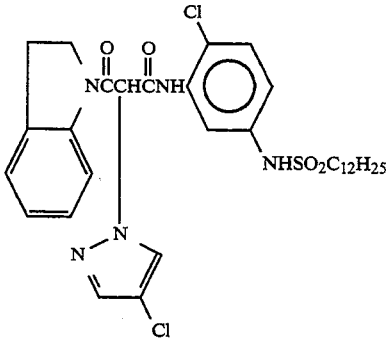
Y-46
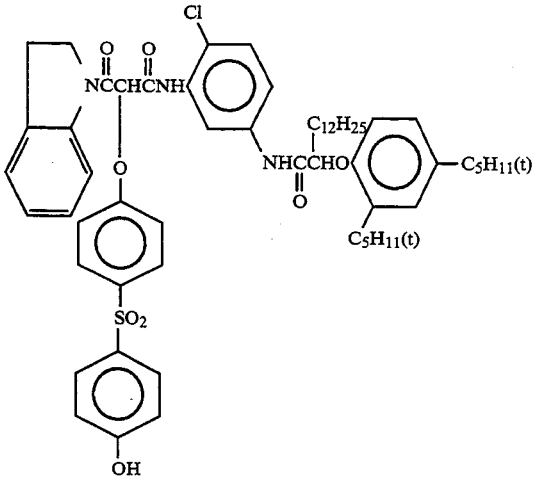
Y-47
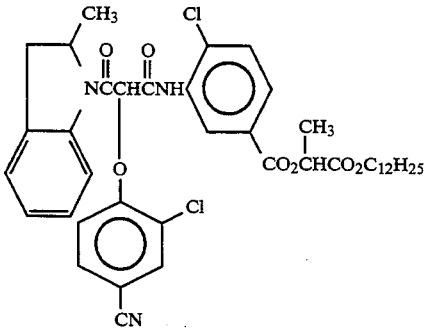
Y-48
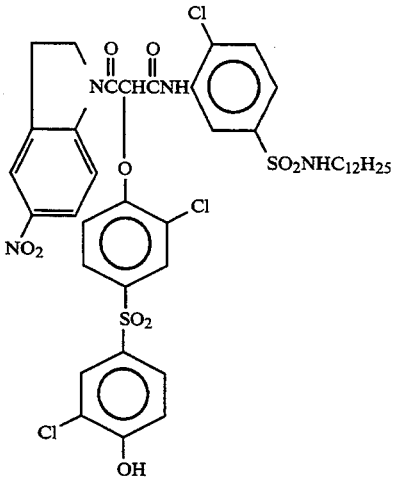

-continued
Y-49
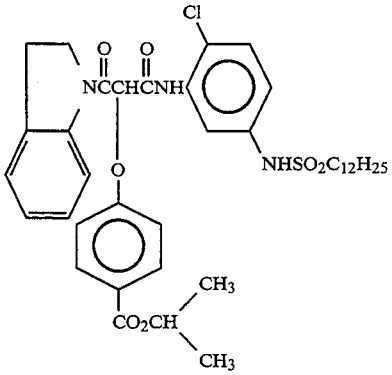
Y-50
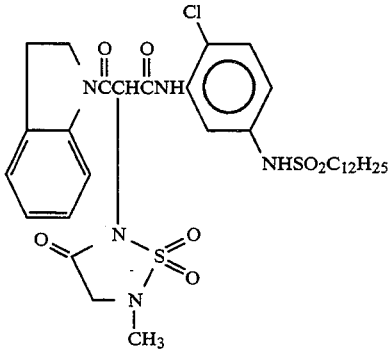
Y-51
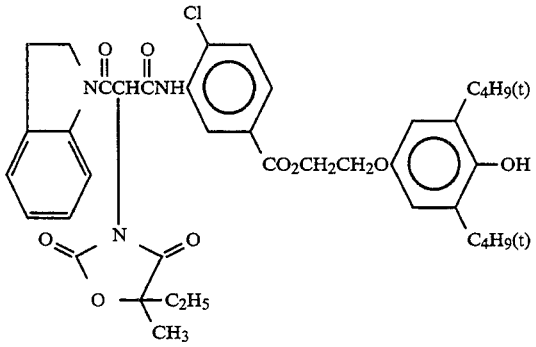
Y-52
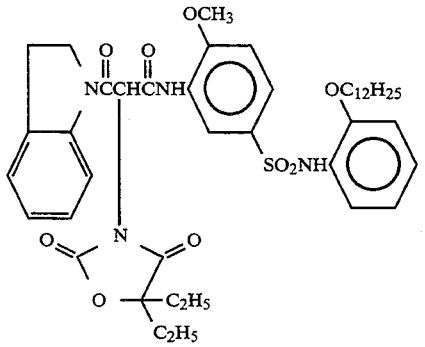

-continued
Y-53
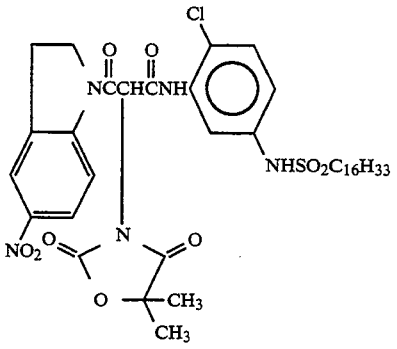
Y-54
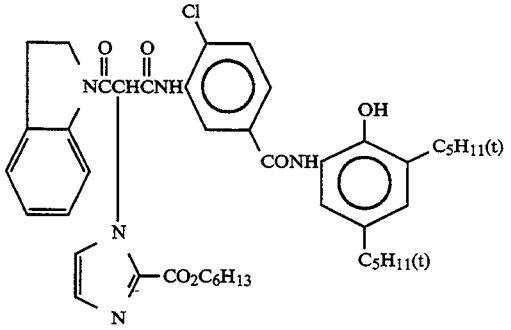
Y-55
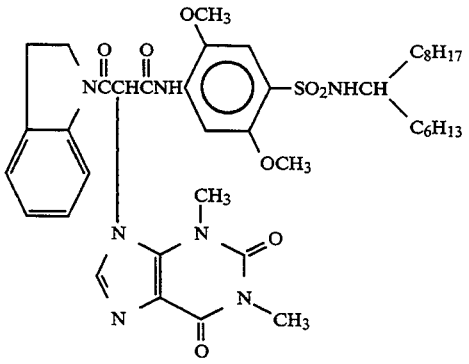
Y-56
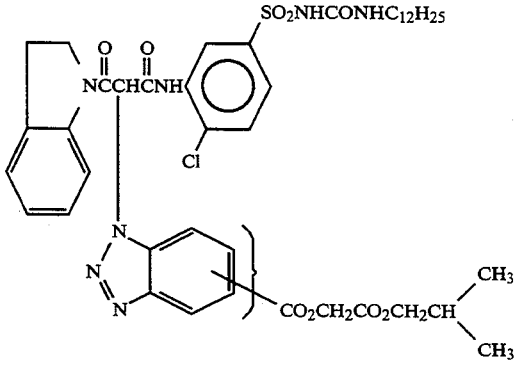

-continued
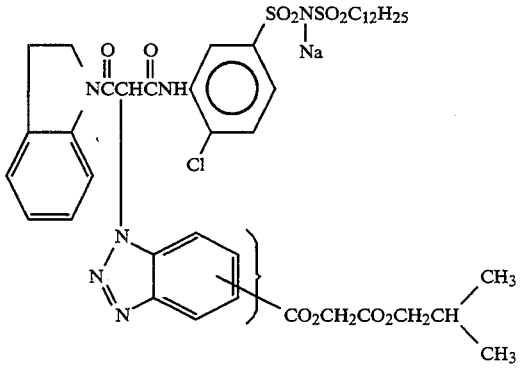
Y-57
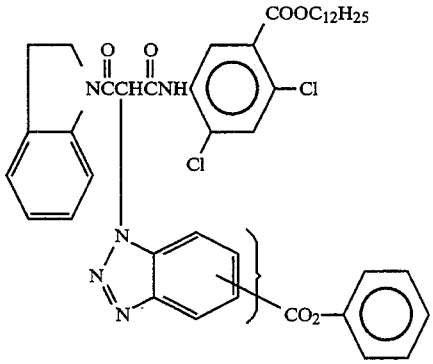
Y-58
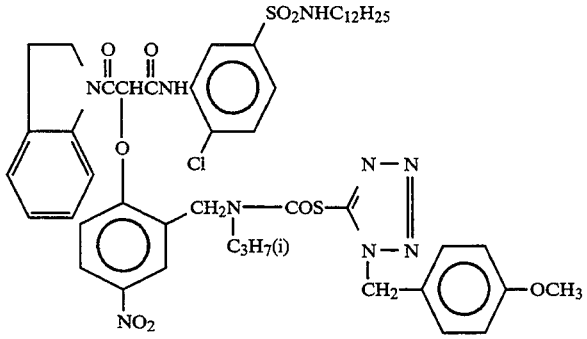
Y-59
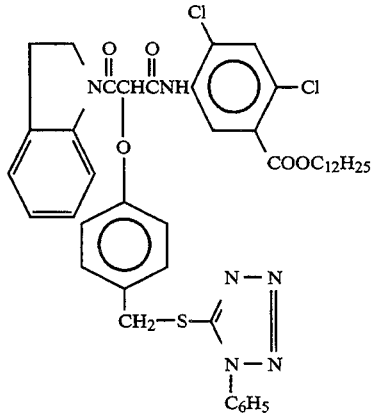
Y-60

-continued
Y-61
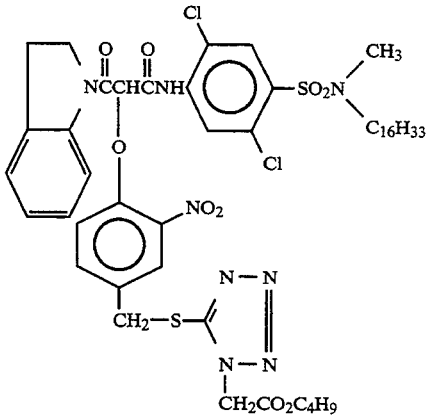
Y-62
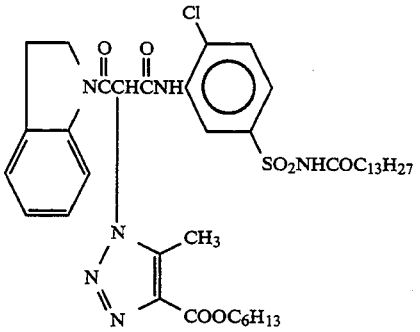
The yellow couplers represented by general formulae (1) to (5) according to the present invention can by synthesized by the following reaction scheme.
SYNTHESIS EXAMPLE 1
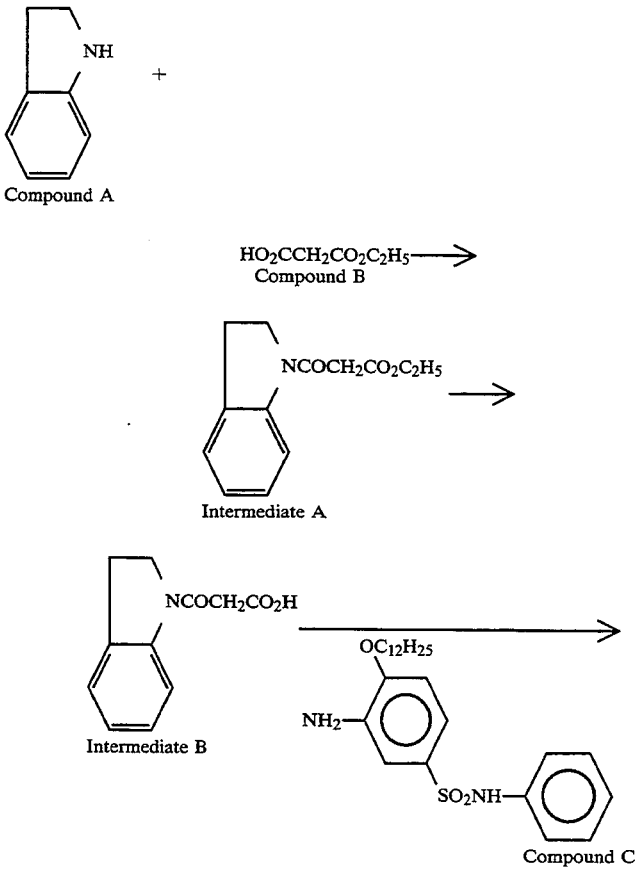

-continued

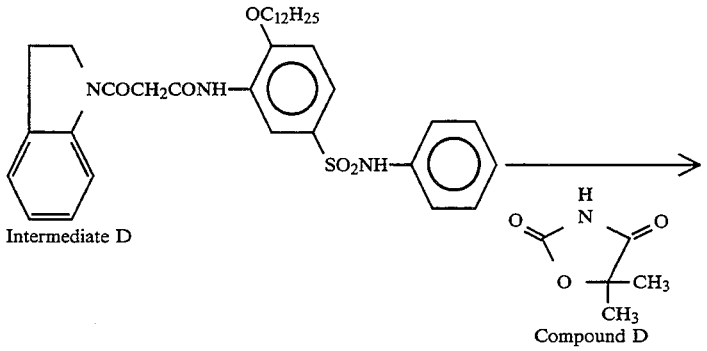

Intermediate D

Compound D

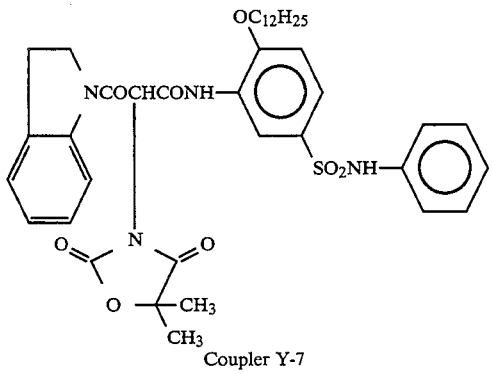

Coupler Y-7

Synthesis of intermediate B 357.5 g ( 3.0 mol ) of compound A and 396.3 g ( 3.0 mol) of compound B were dissolved in 1.2 l of ethyl acetate and 0.6 l of dimethylformamide,. While stirring the resulting solution, an acetonitrile ( 400 ml ) solution of 631g (3.06 mol) of dicyclohexylcarbodiimide was added dropwise thereto at a temperature of 15° to 35° C. The mixture was reacted at a temperature of 20° to 30° C for 2 hours, and the precipitated dicyclohexylurea was recovered by filtration. To the filtrate, there were added 500 ml of ethyl acetate and 1 l water. The water layer was removed. The organic layer was washed twice with 1 l of water, and dried over anhydrous sodium sulfate. Ethyl acetate was distilled off under reduced pressure to obtain 692 g (98.9%) of intermediate A as an oily product.

692 g (2.97 mol) Of intermediate A was dissolved in 3 l of ethyl alcohol. While stirring the resulting solution, 430 g of a 30% aqueous sodium hydroxide solution was added dropwise thereto at a temperature of 5° to 80° C. After dropwise addition, the mixture was reacted at the same temperature for 30 minutes, and the precipitated crystal was recovered by filtration. Yield: 658g The crystal was suspended in 5 l of water. Subsequently, 300 ml of concentrated hydrochloric acid was added dropwise to the resulting suspension while stirring. The mixture was stirred at the same temperature for one hour, and the resulting crystal was recovered by filtration to obtain 579 g (95%) of intermediate B. Decomposition point: 127° C.

Synthesis of intermediate D 45.1 g ( 0.22 mol ) of intermediate B and 86.6 g (0.2 mol) of compound C were dissolved in 400 ml of ethyl acetate and 200 mol of dimethylacetamide. An acetonitrile (400 ml) solution of 66 g (0.32 mol) of dicyclohexylcarbodiimide was added dropwise to the resulting solution while stirring at a temperature of 15° to 30° C. The mixture was reacted at 20° to 30° C for 2 hours, and the precipitated dicyclohexylurea was recovered by filtration.

To the filtrate were added 400 ml of ethyl acetate and 600 ml of water. After removing the aqueous layer, the organic layer was washed with water twice, and dried over anhydrous sodium sulfate. Ethyl acetate was distilled off under reduced pressure to obtain 162g of an oily product.

The oily product was crystallized from 100 ml of ethyl acetate and 300 ml of n-hexane to obtain 108 g (87.1%) of intermediate D. Melting point: 132°-134° C.

TABLE 1

| | Elemental analysis for intermediate D | | |
|---|---|---|---|
| | C % | H % | N % |
| Calculated | 67.82 | 7.32 | 6.78 |
| Found | 67.81 | 7.32 | 6.76 |

Synthesis of coupler Y-7

In 300 ml of dichloromethane was dissolved 49.6 g (0.08 mol) of intermediate D. To the resulting solution was added dropwise 11.4 g ( 0.084 mol ) of sulfuryl chloride while stirring at 10° to 15° C.

The mixture was reacted at the same temperature for 30 minutes, and 200 g of a 5% aqueous solution of sodium bicarbonate was then added to the reaction mixture. The organic layer was recovered, washed with 200 ml of water and dried over anhydrous sodium sulfate. Dichloromethane was then distilled off to obtain 47 g of an oily material.

47 g of the oily material was dissolved in 200 ml of acetonitrile, and 28.4 g (0.22 mol) of compound D and 22.2 g ( 0.22 mol ) of triethylamine were added thereto while stirring at 40° to 50° C. The mixture was reacted at 40° to 50° C for 4 hours and poured into 300 ml of water. The precipitated oily material was extracted with 300 ml of ethyl acetate, the organic layer was washed with 200 g of a 5% aqueous solution of sodium hydroxide and then with 300 ml of water twice. The organic layer was acidified with dilute hydrochloric acid, washed with water twice and concentrated under reduced pressure to obtain a residue. Yield: 70 g The resulting oily material was crystallized from a mixed solvent of 50 ml of ethyl acetate and 100 ml of n-hexane to obtain 47.8 g (80%) of coupler Y-7. Melting point: 145° -7° C.

TABLE 2

| | Elemental analysis for coupler Y-7 | | |
|---|---|---|---|
| | C % | H % | N % |
| Calculated | 64.32 | 6.75 | 7.50 |
| Found | 64.31 | 6.73 | 7.50 |

SYNTHESIS EXAMPLE 2

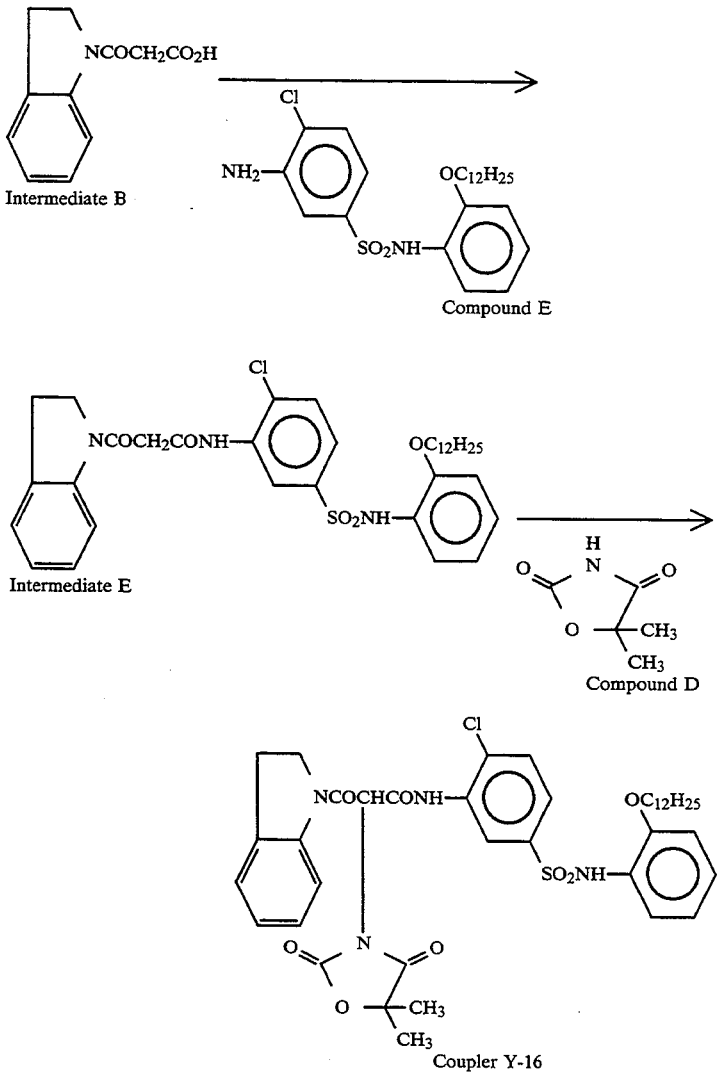

Synthesis of intermediate E 90.3 g (0.44 mol) of intermediate B and 187 g (0.4 mol) of compound E were dissolved in 500 ml of ethyl acetate and 300 ml of dimethylformamide. An acetonitrile (200 ml) solution of 131.9 g (0.64 mol) of dicyclohexylcarbodiimide was added dropwise to the resulting solution while stirring at 15° to 30° C.

The mixture was reacted at 20° to 30° C for 2 hours, and the precipitated dicyclohexylurea was recovered by filtration. To the filtrate were added 500 ml of ethyl acetate and 600 ml of water. After removing the aqueous layer, the organic layer was washed with water twice and dried over anhydrous sodium sulfate. Ethyl acetate was distilled off under reduced pressure to obtain 281 g of an oily material.

The oily material was dissolved in 1.5 l of n-hexane by heating, and insoluble matters were removed by filtration. The n-hexane solution was cooled with water, and the precipitated intermediate E was recovered by filtration. Yield: 243.4 g (93%). Melting point: 103°-5° C.

TABLE 3

| | Elemental analysis for intermediate E | | |
|---|---|---|---|
| | C % | H % | N % |
| Calculated | 64.32 | 6.78 | 6.42 |
| Found | 64.24 | 6.76 | 6.43 |

Synthesis of coupler Y-16

In 200 ml of dichloromethane was dissolved 39.3 g ( 0.06 mol ) of intermediate E. To the resulting solution was added dropwise 8.7 g ( 0. 064 mol ) of sulfuryl chloride while stirring at 10° to 15° C.

The mixture was reacted at the above temperature for 30 minutes, and 200 g of a 4% aqueous solution of sodium bicarbonate was added dropwise to the reaction mixture. The organic layer was recovered, washed with 200 ml of water and dried over anhydrous sodium sulfate. Dichloromethane was distilled off under reduced pressure to obtain 41.3 g of an oily material.

41.3 g of the oily material was dissolved in 100 ml of acetonitrile and 200 ml of dimethylacetamide. To the resulting solution were added 20.8 g (0.16 mol) of compound D and 16.2 g of triethylamine while stirring. The mixture was reacted at 30° to 40° C for 3 hours and then poured into 400 ml of water. The precipitated oily material was extracted with 300 ml of ethyl acetate. The organic layer was washed with 300 g of a 2% sodium hydroxide solution and further with water twice. The organic layer was acidified with dilute hydrochloric acid, washed with water twice and concentrated under reduced pressure to obtain 42 g of a residue.

The residue was crystallized from 200 ml of methanol to obtain 39.8 g (85%) of coupler Y-16. Melting point: 110°–112° C.

TABLE 4

| | Elemental analysis for coupler Y-16 | | |
|---|---|---|---|
| | C % | H % | N % |
| Calculated | 61.48 | 6.32 | 7.17 |
| Found | 61.46 | 6.30 | 7.18 |

SYNTHESIS EXAMPLE 3

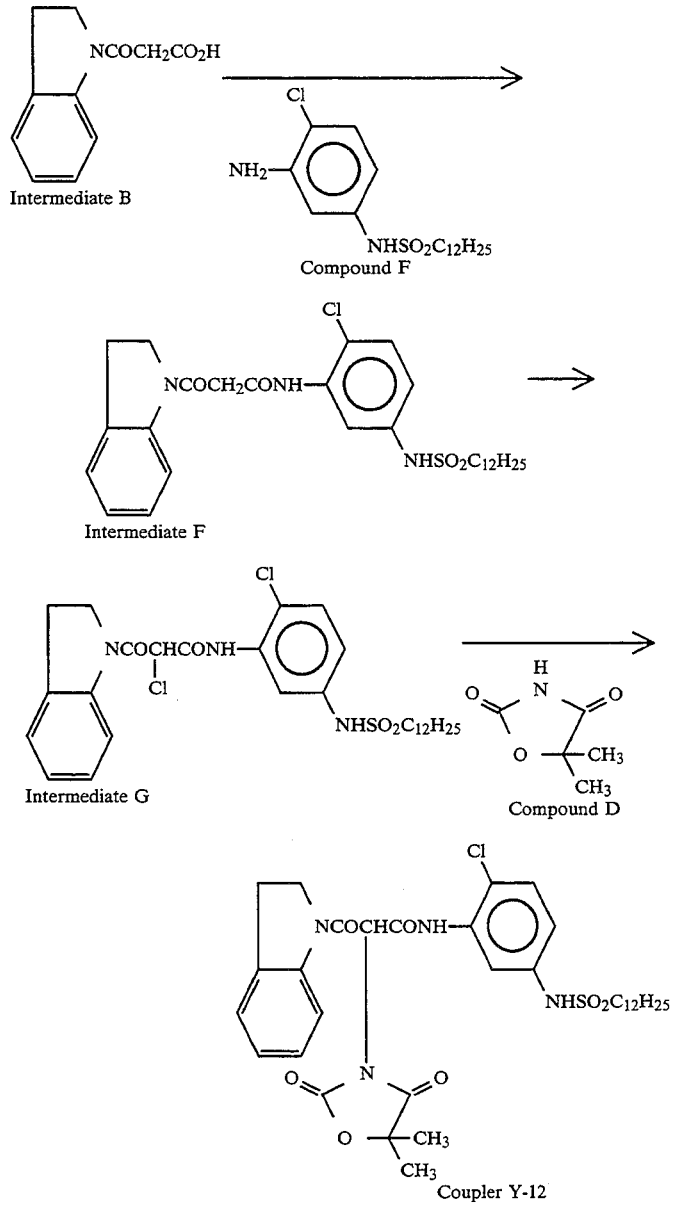

Synthesis of intermediate F 104.7 g (0.51 mol) of intermediate B and 187.5 g (0.5 mol) of compound F were dissolved in 1 l of ethyl acetate and 400 ml of dimethylformamide. A dimethylformaldehyde (100 ml ) solution of 107.3 g (0. 525 mol ) of dicyclohexylcarbodiimide was added dropwise to the resulting solution while stirring at 15° to 30° C. The mixture was reacted at 20° to 30° C. for one hour, and 500 ml of ethyl acetate was added thereto. The mixture was heated to 50° to 60° C. and dicyclohexylurea was recovered by filtration.

To the liltrate was added 500 ml of water. After removing the aqueous layer, the organic layer was washed with water twice, and dried over anhydrous sodium sulfate. Ethyl acetate was distilled off under reduced pressure to obtain 290 g of an oily material. The oily material was dissolved in 1 l of ethyl acetate and 2 l of methanol. Insoluble matters were removed by filtration. The filtrate was cooled with water to thereby precipitate intermediate F as a crystal. The crystal was recovered by filtration. Yield: 267 g (95%). Melting point: 163°–4° C.

TABLE 5

| Elemental analysis for Intermediate F | | | |
|---|---|---|---|
| | C % | H % | N % |
| Calculated | 61.95 | 7.17 | 7.48 |
| Found | 61.93 | 7.17 | 7.46 |

Synthesis of intermediate G

In 500 ml of dichloromethane was dissolved 114.0 g (0.2 mol) of intermediate F. To the resulting solution was added dropwise 28.4 g (0.21 mol) of sulfuryl chloride while stirring at 10° to 15° C.

The mixture was reacted at the above temperature, and 500 g of a 6% aqueous solution of sodium bicarbonate was added dropwise to the reaction mixture. The organic layer was recovered, washed with 500 ml of water and dried over anhydrous sodium sulfate. Dichloromethane was distilled off under reduced pressure to thereby precipitate intermediate G as a crystal. The crystal was recovered by filtration. Yield: 108.6 g (91%)

Synthesis of coupler Y-12

In 80 ml of dimethylformamide was dissolved 29.8 g (0.05 mol) of intermediate G. To the resulting solution was added 12.9 g (0.1 mol) of compound D. Subsequently, 10.1 g (0.1 mol) of triethylamine was added dropwise thereto while stirring at 20° to 30° C. The mixture was reacted at 40° to 45° C. for one hour, and 300 ml of ethyl acetate and 200 ml of water were then added thereto. The organic layer was washed with 200 g of a 2% aqueous sodium hydroxide solution and then with water. The organic layer was acidified with dilute hydrochloric acid, washed with water twice and concentrated under reduced pressure to obtain 34 g of a residue. The residue was crystallized from a mixed solvent of 50 ml of ethyl acetate and 150 ml of n-hexane to obtain 19 g of coupler Y-12 as a crystal.

The crystal was recrystallized from 120 ml of a mixed solvent of ethyl acetate/n-hexane=$\frac{1}{3}$ by volume to obtain 15 g (43.5%) of coupler Y-12. Melting point: 135°–6° C.

TABLE 6

| Elemental analysis for coupler Y-12 | | | |
|---|---|---|---|
| | C % | H % | N % |
| Calculated | 59.24 | 6.58 | 8.13 |
| Found | 59.27 | 6.56 | 8.12 |

SYNTHESIS EXAMPLE 4

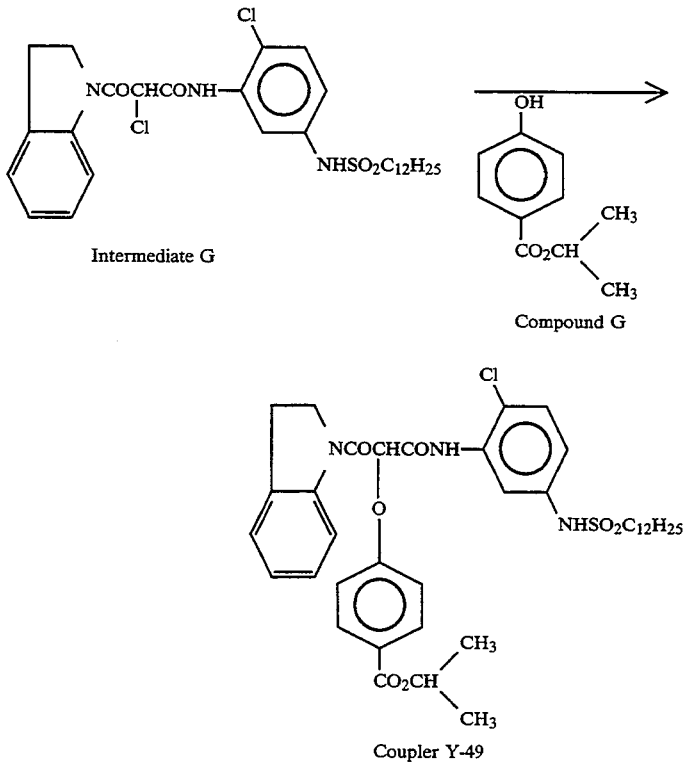

Synthesis of coupler Y-49

In 50 ml of dimethylformamide were dissolved 27.0g (0.15 mol) of compound G and 15.2g (0.15 mol) of triethylamine. To the mixture was added a dimethylformamide (30 ml) solution of 29.8g (0.05 ml) of intermediate G while stirring.

The mixture was reacted at 30° to 40° C. for 4 hours, and 400 ml of ethyl acetate and 300 ml of water were added thereto. The organic layer was washed with 400g of a 2% aqueous solution of sodium hydroxide and further with water twice. The organic layer was acidified with dilute hydrochloric acid, washed with water twice and dried over anhydrous sodium sulfate. Ethyl acetate was distilled off under reduced pressure to obtain 54g of a residue.

The residue was recrystallized from 300 ml of a mixed solvent of ethyl acetate/methanol (½ by volume). Coupler Y-49 was recovered by filtration and the crystal of coupler Y-49 was recrystallized from 200 ml of a mixed solvent of ethyl acetate/methanol (½ by volume) to obtain 28.8 g ( 77.8% ) of coupler Y-49. Melting point: 190°–191° C.

TABLE 7

| | Elemental analysis for coupler Y-49 | | |
|---|---|---|---|
| | C % | H % | N % |
| Calculated | 63.26 | 6.81 | 5.68 |
| Found | 63.24 | 6.79 | 5.67 |

The couplers represented by general formula (F) according to the present invention will be illustrated below.

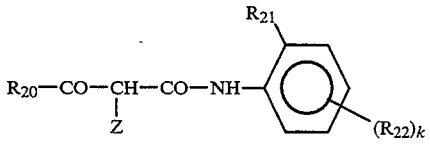

(F)

Examples of the group represented by $R_{22}$ in general formula (F) include a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an arylsulfonyl group, a ureido group, a sulfamoylamino group, an alkoxycarbonylamino group, a nitro group, a heterocyclic group, a cyano group, an acyl group, an acyloxy group, an alkylsulfonyloxy group and an arylsulfonyloxy group. Examples of the releasing group represented by Z include a heterocyclic group which is bonded to the coupling active site through a nitrogen atom, an aryloxy group, an arylthio group, an acyloxy group, an alkylsulfonyloxy group, a heterocyclic oxy group and a halogen atom.

In general formula (F), R20 is preferably a t-butyl group, $R_{21}$ is preferably a halogen atom, an alkoxy group or a phenoxy group. $R_{22}$ is preferably a halogen atom, an alkoxy group, an alkoxycarbonyl group, a carbonamido group, a sulfonamido group, a carbamoyl group or a sulfamoyl group. Z is preferably an aryloxy group or a 5- to 7-membered heterocyclic group containing one or more of N, S, 0 and P which is bonded to the coupling active site through a nitrogen atom, and k is preferably an integer of 0 to 2.

The couplers represented by general formula (F) may be combined through a divalent or polyvalent group at the position of the substituent group to form a dimer or a polymer or to form a homopolymer or a copolymer containing a non-color polymer unit.

Specific examples of the couplers represented by general formula (F) are shown below, but the present invention is not limited to these compounds.

I-1

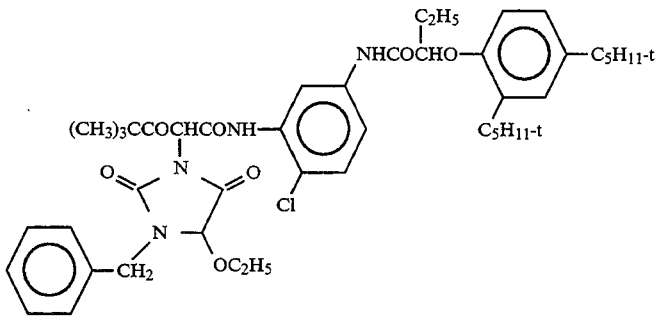

I-2

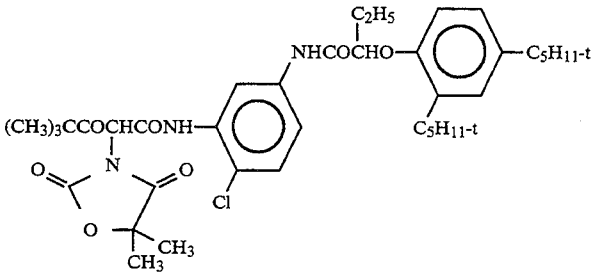

-continued
I-3
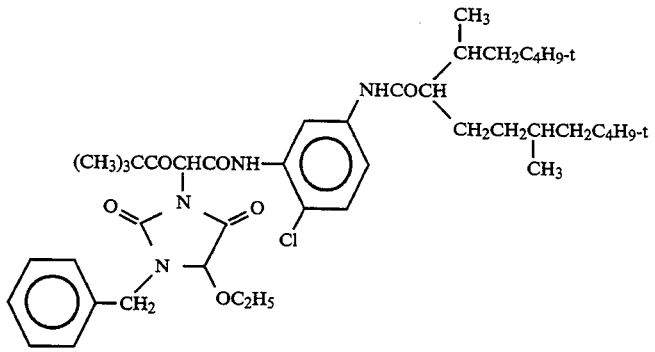
I-4
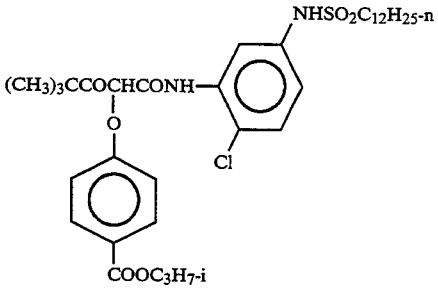
I-5
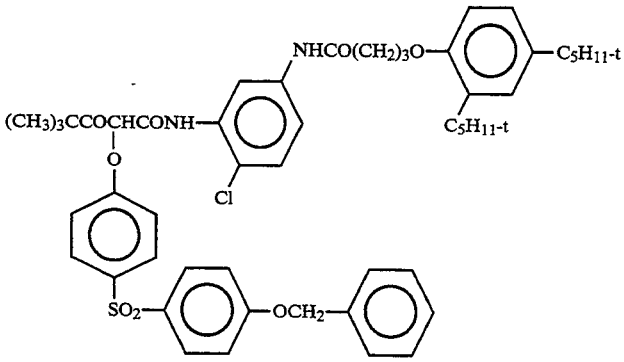
I-6
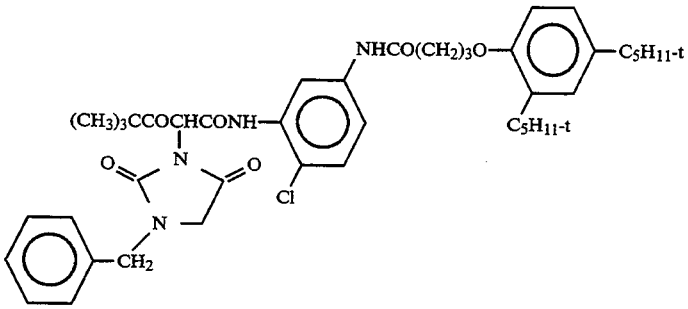
I-7
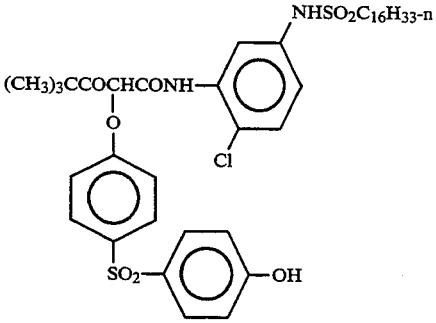

-continued

I-8

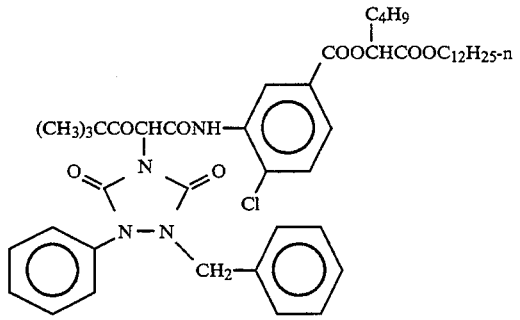

I-9

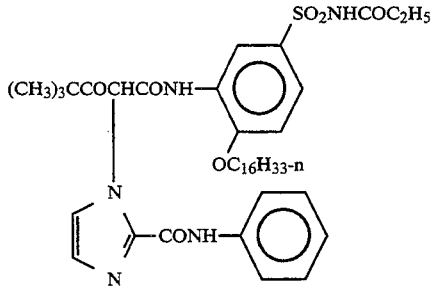

I-10

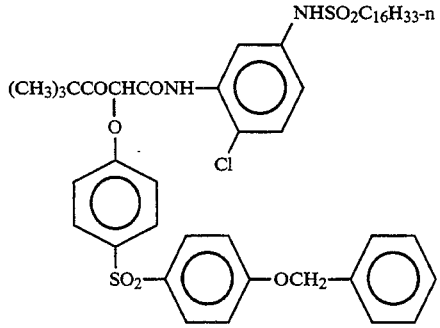

I-11

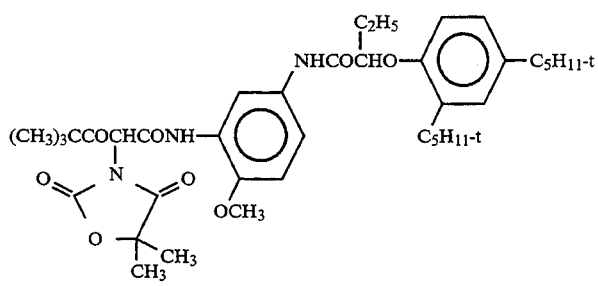

Examples of other compounds and other synthesis methods for yellow couplers, in addition to the above-described yellow couplers, which can be used in the present invention include those described in U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837 and 4,729,944, European Patents 30,747A, 284,081A, 296,793A and 313,308A, West German Patent 3,107,173C, JP-A-58-42044 (the term "JP-A" as used herein means an "unexamined published Japanese patent application"), JP-A-59-174839, JP-A-62-276547 and JP-A-63-123047.

The yellow couplers of general formulae (1) to (5) and the general formula (F) according to the present invention are used in the range of 1.0 to $1.0\times10^{-3}$ mol, preferably $5.0\times10^{-1}$ to $2.0\times10^{-2}$ mol, more preferably $4.0\times10^{-1}$ to $5.0\times10^{-2}$ mol per mol of silver halide.

The yellow couplers of general formulae (1) to (5) may be used either alone or in combination of two or more of them. The yellow couplers of the present invention may be used together with other conventional couplers.

The couplers of general formulae ( 1 ) to ( 5 ) according to the present invention can be introduced into the color light-sensitive materials by various conventional dispersion methods.

There may be used oil-in-water dispersion methods wherein low-boiling organic solvents ( e.g., ethyl acetate, butyl acetate, methyl ethyl ketone, isopropanol) are used, and a fine dispersion is coated to thereby allow substantially no low-boiling organic solvent to be left behind in the dry layers. When high-boiling organic solvents are used, any organic solvent having a boiling point of not lower than 175° C. under atmospheric pressure can be used. These organic solvents may be used either alone or in combination of two or more of them. The ratio of the coupler of the present invention to the high-boiling organic solvent can be varied widely, but the organic solvent is used in a ratio by weight of generally not higher than 5.0, preferably 0 to 2.0, more preferably 0.01 to 1.0 per one gram of the coupler.

Further, latex dispersion methods described hereinafter can be used.

Furthermore, the couplers of the present invention may be mixed with various couplers and compounds described hereinafter, or may be allowed to coexist with them.

Each of the cyan, magenta and yellow couple dispersions may contain the high-boiling organic solvent in a ratio represented by the following formula:

$$0 \leqq \text{High-boiling organic solvent (weight)/ coupler (weight)} \leqq 1.0$$

The ratio is preferably not higher than 0.7, more preferably not nigher than 0.5 from the viewpoint of improving sharpness and improving the strength of the layers.

The high-boiling organic solvent in the above formula refers to one which is co-emulsified.

The light-sensitive material of the present invention may comprise a support having thereon at least one silver halide emulsion layer of a blue color-sensitive layer, a green color sensitive layer and a red color-sensitive layer. There is no particular limitation with regard to the number of silver halide emulsion layers and the non-sensitive emulsion layers and the order of the layers. A typical example thereof is a silver halide photographic material having at least one light-sensitive layer comprising a plurality of silver halide emulsion layers having substantially the same color sensitivity, but different light-sensitivity. The light-sensitive layer is a unit light-sensitive layer having color sensitivity to any one of blue light, green light and infrared light. In a multilayer silver halide color photographic material, the unit light-sensitive layers are generally arranged in an order of a red color-sensitive layer, a green color-sensitive layer and blue color-sensitive layer from the side of the support. However, the arrangement may be made in the reverse order to that described above according to the intended purpose. If desired, the arrangement may be made in such a manner that between layers having the same color sensitivity, there is provided a light-sensitive layer having a different color sensitivity.

Various non-sensitive layers such as interlayers may be provided between the above silver halide light-sensitive layers and as the uppermost layer and the lowermost layer. The interlayers may contain couplers, DIR compounds, etc. described in JP-A-61-43748, JP-A-59-113438, JP-A-59-113440, JP-A-61-20037 and JP-A-61-20038, and they may contain conventional color mixing inhibitors.

A plurality of silver halide emulsion layers which constitute each unit light-sensitive layer are preferably in the form of a double layer structure composed of a high-sensitivity emulsion layer and a low-sensitivity emulsion layer. Generally, it is preferred that the layers are arranged in such a manner that light-sensitivity is lowered toward the support. A non-sensitive layer may be provided between the silver halide emulsion layers. The low-sensitivity emulsion layer may be provided on the side farther away from the support, and the high-sensitivity emulsion layer may be provided on the side nearer the support as described in JP-A-57-112751, JP-A-62-200350, JP-A-62-206541 and JP-A-62-206543.

Specifically, the arrangement may be made in an order of low-sensitivity blue-sensitive layer (BL)/high-sensitivity blue-sensitive layer (BH)/high-sensitivity green-sensitive layer(GH)/low-sensitivity green-sensitive layer(GL)/high-sensitivity red-sensitive layer (RH)/low-sensitivity red-sensitive layer(RL), in an order of BH/BL/GL/GH/RH/RL or in an order of BH/BL/GH/GL/RL/RH from the side which is farthest away from the support.

The arrangement may be made in an order of blue-sensitive layer/GH/RH/GL/RL from the side which is farthest away from the support as described in JP-B-55-34932 (the term "JP-B" as used herein means an "examined Japanese patent publication"). Further, the arrangement may be made in order of blue-sensitive layer/GL/RL/GH/RH from the side which is farthest away from the support as described in JP-A-56-25738 and JP-A-62-63936.

Furthermore, a three layer structure comprising three layers having different light sensitivity may be used wherein the light sensitivity is lowered in turn toward the support in such a manner that the upper layer is a silver halide emulsion layer having the highest light sensitivity, the intermediate layer is a silver halide emulsion layer having light sensitivity lower than that of the upper layer and the lower layer is a silver halide emulsion layer having light sensitivity lower than that of the intermediate layer as described in JP-B-49-15495. In such a three layer structure composed of three layers having different light sensitivity, the arrangement in the layers having the same color sensitivity may be made in an order of intermediate sensitivity emulsion layer/-high-sensitivity emulsion layer/low-sensitivity emulsion layer from the side which is farther away from the support as described in JP-A-59-202464.

In addition, the arrangement may be made in an order of high-sensitivity emulsion layer/low sensitivity emulsion layer/intermediate-sensitivity emulsion layer or in an order of low-sensitivity emulsion layer/intermediate-sensitivity emulsion layer/high-sensitivity emulsion layer. A four or more layer structure may be used, and various arrangements may be made.

It is preferred that a donor layer (CL) having an interlayer effect having a different spectral sensitivity distribution from that of the main light-sensitive layers, such as BL, GL and RL as described in U.S. Pat. Nos. 4,663,271, 4,705,744 and 4,707,436, JP-A-62-160448 and JP-A-63-89850, is arranged adjacent or close to the main light-sensitive layers to improve color reproducibility.

As described above, various layer structures and arrangements can be chosen according to the purpose of the light-sensitive materials.

Preferred silver halides to be contained in the photographic emulsion layers of the photographic materials of the present invention are silver iodobromide, silver iodochloride and silver iodochlorobromide, each having a silver iodide content of not higher than 30 mol%. Particularly preferred are silver iodobromide and silver iodochlorobromide, each having a silver iodide content of about 2 to about 10 mol %.

Silver halide grains in the photographic emulsions may have a regular crystal form such as a cubic, octahedral or tetradecahedral form, an irregular crystal form such as a spherical or plate form, a crystal form having crystal defects such as a twinning plane, or a composite form thereof.

With regard to grain size, silver halide grains may range from fine grains having a grain size of not larger than about 0.2 μm to larger-size grains having a grain size of about 10 μm in terms of the diameter of a circle having an area equal to the projected area of the grain. Either a polydisperse emulsion and/or a monodisperse emulsion may be used.

Silver halide emulsions which can be used in the present invention can be prepared according to the methods described in *Research Disclosure* (RD) No. 17643 (December 1978), pp. 22–23, "I. Emulsion Preparation and Types" *Research Disclosure* No. 18716 (November 1979), page 648; *Research Disclosure* No. 307105 (November 1989), pp. 863–865; P. Glafkides, *Chemie et Phisique Photographique* (Paul Montel 1967); G. F. Duffin, *Photographic Emulsion Chemistry* (Focal Press 1966); and V. L. Zelikman et al., *Making and Coating Photographic Emulsion* (Focal Press 1964 ).

Monodisperse emulsions described in U.S. Pat. Nos. 3,574,628 and 3,655,394 and U.K. Patent 1,413,748 can preferably be used.

Tabular grains having an aspect ratio of not lower than about 3 can be used in the present invention. The tabular grains can be easily prepared according to the methods described in Gutoff, *Photographic Science and Engineering,* Vol. 14, pp. 248–257 (1970), U.S. Pat. Nos. 4,434,226, 4,414,310, 4,443,048, and 4,439,520 and U.K. Patent 2,112,157.

The crystal structure may be uniform, or the interior and surface layer of the grain may be different in halogen composition from each other. The crystal structure of the grain may be a laminar structure. Silver halides having different compositions may be joined by epitaxial growth. Silver halide may be joined to a compound other than silver halide, such as silver thiocyanate or lead oxide. A mixture of grains having various crystal forms may be used.

The above-described emulsions may be a surface latent image type wherein a latent image is predominantly formed on the surface of the grain or an internal latent image type wherein a latent image is predominantly formed in the interior of the grain. However, the emulsions must be a negative type. With regard to the internal latent image type, core/shell type internal latent image type emulsions described in JP-A-63-264740 may be used. A method for preparing the core/shell type internal latent image type emulsions is described in JP-A-59-133542. The thickness of the shell of the grain used in the emulsions varies depending on development conditions, but is preferably 3 to 40 nm, particularly preferably 5 to 20 nm.

The silver halide emulsions are generally subjected to physical ripening, chemical ripening and spectral sensitization. Additives used in these stages are described in *Research Disclosure* No. 17643, ibid. No. 18716 and ibid. No. 307105, and the locations of these disclosures are summarized in the table described hereinafter.

Two or more light-sensitive silver halide emulsions having different properties with respect to at least one of grain size, grain size distribution, halogen composition, grain form and sensitivity may be mixed and used in the same layer of the light-sensitive material of the present invention.

Silver halide grains wherein the surfaces of the grains are fogged as described in U.S. Pat. No. 4,082,553, silver halide grains wherein the interiors of the grains are fogged as described in U.S. Pat. No. 4,626,498 and JP-A-59-214852 and colloidal silver can be preferably used in light-sensitive silver halide emulsion layers and/or substantially non-sensitive hydrophilic colloid layers. The term "silver halide grains wherein the surfaces and/or interiors of grains are fogged" as used herein refer to silver halide grains which can be uniformly (non-imagewise ) developed irrespective of the unexposed area and exposed area of the light-sensitive material. Methods for preparing silver halide grains wherein the interiors and surfaces of the grains are fogged are described in U.S. Pat. No. 4,626,498 and JP-A-59-214852.

Silver halide for use in forming the internal nuclei of the core/shell type silver halide grains wherein the interiors of the grains are fogged, may be one having the same halogen composition or a different halogen composition. Any of silver chloride, silver chlorobromide, silver iodobromide and silver chloroiodobromide can be used as silver halide wherein the interiors or surfaces of the grains are fogged. These fogged silver halide grains have a mean grain size of preferably 0.01 to 0.75 μm, particularly preferably 0.05 to 0.6 μm, though there is no particular limitation with regard to grain size. Further, there is no particular limitation with regard to grain shape, and grains may have a regular form and polydisperse emulsion may be used. However, a monodisperse (at least 95%, in terms of the number of grains or the weight of grains has a grain size of within ±40% of mean grain size) emulsion is preferred.

It is preferred that non-sensitive fine silver halide grains are used in the present invention. The term "non-sensitive fine silver halide grains" as used herein refers to fine silver halide grains which are neither sensitive to light during imagewise exposure for obtaining a dye image and are substantially not developed in the development stage. Grains which are previously not fogged are preferred.

Fine silver halide grains have a silver bromide content of 0 to 100 mol % and may optionally contain silver chloride and/or silver iodide. Grains having a silver iodide content of 0.5 to 10 mol % are preferred.

Fine silver halide grains have a mean grain size (the mean value of the diameters of circles corresponding to the projected areas of the grains ) of preferably 0.01 to 0.5 μm, more preferably 0.02 to 0.2 μm.

The fine silver halide grains can be prepared in the same manner as in the preparation of conventional light-sensitive silver halides. In this case, the surfaces of the silver halide grains do not need to be optically sensitized, and spectral sensitization is not required. However, it is preferred that conventional stabilizers such as triazole, azaindene, benzthiazolium or mercapto compounds or zinc compounds are previously added before the fine silver halide grains are added to coating solution. Further, colloidal silver can be contained in the layer containing the fine silver halide grains.

The coating weight of silver in the light-sensitive materials of the present invention is preferably not more than 6.0 g/m$^2$, most preferably not more than 4.5 g/m$^2$.

Conventional photographic additives which can be used in the present invention are described in the aforesaid three *Research Disclosures* and indicated in the following Table.

| | Additive | RD17643 | RD18716 | RD307105 |
|---|---|---|---|---|
| 1. | Chemical Sensitizers | Page 23 | Page 648, right hand column | Page 866 |
| 2. | Speed Increasing Agents | | Page 648, right hand column | |
| 3. | Spectral Sensitizers, Super-Sensitizers | Pages 23–24 | Page 648 right hand column–page 649 right hand column | Pages 866–868 |
| 4. | Brightening Agents | Page 24 | Page 647, right hand column | Pages 868 |
| 5. | Anti-foggants, Stabilizers | Pages 24–25 | Page 649, right hand column | Pages 868–870 |
| 6. | Light Absorbers, Filter Dyes and Ultraviolet absorbers | Pages 25–26 | Page 649, right hand column–page 650, left hand column | Page 873 |
| 7. | Anti-staining Agents | Page 25, right hand column | Page 650, left hand column–right hand column | Page 872 |
| 8. | Dye Image Stabilizers | Page 25 | page 650, left hand column | Page 872 |
| 9. | Hardening Agents | Page 26 | Page 651, left hand column | Pages 874–875 |
| 10. | Binders | Page 26 | Page 651, left hand column | Pages 873–874 |
| 11. | Plasticizers, Lubricants | Page 27 | Page 650, right hand column | Page 876 |
| 12. | Coating aids Surfactants | Pages 26–27 | Page 650, right hand column | Pages 875–876 |
| 13. | Anti-static agents | Page 27 | Page 650, right hand column | Pages 876–877 |
| 14. | Matting Agents | | | Pages 878–879 |

It is preferred that compounds capable of reacting with formaldehyde to fix it as described in U.S. Pat. Nos. 4,411,987 and 4,435,503 are added to the light-sensitive materials to prevent photographic performance from being deteriorated by formaldehyde gas.

It is also preferred that mercapto compounds described in U.S. Pat. Nos. 4,740,454 and 4,788,132, JP-A-62-18539 and JP-A-1-283551 are contained in the light-sensitive materials of the present invention.

Further, it is preferred that compounds capable of releasing a fogging agent, a development accelerator, a solvent for silver halide or a precursor thereof, irrespective of the amount-of silver formed by development, (i.e., compounds described in JP-A-l-106052) are contained in the light-sensitive materials of the present invention.

Furthermore, it is preferred that dyes dispersed by the methods described in WO (PCT) 88/04794 and JP-A-1-502912 or dyes described in EP 317,308A, U.S. Pat. No. 4,420,555 and JP-A-1-259358 are contained in the light-sensitive materials of the present invention.

Various color couplers can be used in the present invention. Concrete examples thereof are described in the patent specifications cited in the aforesaid *Research Disclosure* No. 17643, VII-C-G and ibid. No. 307105, VII-C-G.

Preferred yellow couplers include the compounds represented by general formulae (1 ) to (5) according to the present invention and those described in U.S. Pat. Nos. 3,933,501, 4,022,620, 4,326,024, 4,401,752 and 4,248,961, JP-B-58-10739, U.K. Patent 1,425,020 and 1,476,760, U.S. Pat. Nos. 3,973,968, 4,314,023 and 4,511,649 and European Patent 249,473A.

Preferred examples of magenta couplers include 5-pyrazolone compounds and pyrazoloazole compounds. Magenta couplers described in U.S. Pat. Nos. 4,310,619 and 4,351,897, European Patent 73,636, U.S. Pat. Nos. 3,061,432 and 3,725,067, *Research Disclosure* No. 24220 (June 1984 ), JP-A-60-33552, *Research Disclosure* No. 24230 (June 1984 ), JP-A-60-43659, JP-A-61-72238, JP-A-60-35730, JP-A-55-118034, JP-A-60-185951, U.S. Pat. Nos. 4,500,630, 4,540,654 and 4,556,630 and WO (PCT) 88/04795 are particularly preferred.

Examples of cyan couplers include phenol couplers and naphthol couplers. Preferred examples of the cyan couplers include those described in U.S. Pat. Nos. 4,052,212, 4,146,396, 4,228,233, 4,296,200, 2,369,929, 2,801,171, 2,772,162, 2,895,826, 3,772,002 3,758,308, 4,334,011 and 4,327,173, West German Patent Application (OLS) No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199 and JP-A-61-42658. Further pyrazoloazole couplers described in JP-A-64-553, JP-A-64-554, JP-A-64-555 and JP-A-64-556 and imidazole couplers described in U.S. Pat. No. 4,818,672 can be used.

Typical examples of dye forming polymer couplers are described in U.S. Pat. Nos. 3,451,820, 4,080,211, 4,367,282, 4,409,320, and 4,576,910, U.K. Patent 2,102,137 and European Patent 341,188A.

Preferred examples of couplers which provide developed dyes having proper diffusibility include those described in U.S. Pat. No. 4,366,237, U.K. Patent 2,125,570, European Patent 96,570 and West German Patent Application (OLS) No. 3,234,533.

Preferred examples of colored couplers for correcting undesirable absorption of developed dyes include those described in *Research Disclosure* No. 17643, item VII-G, ibid. No. 307105, item VII-G, U.S. Pat. No. 4,163,670, JP-B-57-39413, U.S. Pat. Nos. 4,004,929 and 4,138,258 and U.K. Patent 1,146,368. There can preferably be used couplers for correcting undesirable absorption of developed dyes by fluorescent dyes released on coupling as described in U.S. Pat. No. 4,774,181, and couplers having, as a releasing group, a dye precursor group capable of forming a dye by the reaction with a developing agent as described in U.S. Pat. No. 4,777,120.

Compounds capable of releasing a photographically useful residue on coupling can preferably be used in the present invention. Preferred examples of DIR couplers which release a development inhibitor include those described in patent specifications cited in the aforesaid RD 17643, item VII-F and $R_D$ 307105, item VII-F, JP-A-57-151944, JP-A-57-154234, JP-A-60-184248, JP-A-63-37346, JP-A-63-37350 and U.S. Pat. Nos. 4,248,962 and 4,782,012.

Couplers which release a bleaching agent as described in RD No. 11449, ibid. 24241 and JP-A-61-201247 are effective in shortening the time of the processing stage having a bleaching power, and the effect thereof is particularly remarkable when added to the light-sensitive materials using tabular silver halide grains. Preferred examples of couplers which release imagewise a nucleating agent or a development accelerator during development include those described in U.K. Patents 2,097,140 and 2,131,188, JP-A-59-157638 and JP-A-59-170840. Further, there can preferably be used couplers which release a fogging agent, a development accelerator, a solvent for silver halide, etc. by an oxidation-reduction reaction with the oxidation product of developing agents as described in JP-A-60-107029, JP-A-60-252340, JP-A-1-44940 and JP-A-1-45687.

Other compounds which can be used in the light-sensitive materials of the present invention include competitive couplers described in U.S. Pat. No. 4,130,427; polyequivalent type couplers described in U.S. Pat. Nos. 4,283,472, 4,338,393 and 4,310,618; DIR redox compound releasing couplers, DIR coupler releasing couplers, DIR coupler releasing redox compounds or DIR redox releasing redox compounds described in JP-A-60-185950 and JP-A-62-24252; couplers which release a dye whose color is restored after elimination as described in European Patents 173,302A and 313,308A; couplers which release a ligand as described in U.S. Pat. No. 4,555,477; couplers which release a leuco dye as described in JP-A-63-75747; and couplers which release a fluorescent dye as described in U.S. Pat. No. 4,774,181.

The couplers used in the present invention can be introduced into the light-sensitive materials by various conventional dispersion methods.

Examples of high-boiling solvents which can be used in oil-in-water dispersion methods are described in U.S. Pat. No. 2,322,027. Specific examples of high-boiling organic solvents having a boiling point of not lower than 175° C. under atmospheric pressure which can be used in the present invention include phthalic esters (e.g., dibutyl phthalate, dicyclohexyl phthalate, di-2-ethylhexyl phthalate, decyl phthalate, his ( 2,4-di-t-amylphenyl) phthalate, bis (2,4-di-t-amylphenyl ) isophthalate, bis (1,1-diethylpropyl ) phthalate ); phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichloropropyl phosphate, di-2-ethylhexylphenyl phospha t e ); benzoic esters (e.g., 2-ethylhexyl benzoate, dodecyl benzoate, 2-ethylhexyl p-hydroxybenzoate ); amides (e.g., N, N-d i e thy 1 dodecaneami de, N,N-diethyllaurylamide, N-tetradecylpyrrolidone ); alcohols or phenols ( e. g., isostearyl alcohol, 2,4-di-tert-amylphenol ); aliphatic carboxylic acid esters (e.g., bis(2-ethylhexyl ) sebacate, dioctyl azelate, glycerol tributyrate, isostearyl lactate, trioctyl citrate); aniline derivatives ( e.g., N,N-dibutyl-2-butoxy-5-t-octylaniline ); and hydrocarbons ( e.g., paraffin, dodecylbenzene, diisopropylnaphthalene). Organic solvents having a boiling point of not lower than about 30° C., preferably not lower than 50° C., but not higher than about 160° C. can be used as co-solvents. Typical examples of such organic solvents include ethyl acetate, butyl acetate, ethyl propionate, methyl ethyl ketone, cyclohexanone, 2-ethoxyethyl acetate and dimethylformamide.

The stages and effects of latex dispersion methods and examples of impregnating latexes are described in U.S. Pat. No. 4,199,363 and West German Patent Application (OLS) Nos. 2,541,274 and 2,541,230.

It is preferred that antiseptic agents or antifungal agents such as phenethyl alcohol or 1,2-benzisothiazoline-3-one, n-butyl p-hydroxybenzoate, phenol, 4-chloro-3,5-dimethylphenol, 2-phenoxyethanol and 2-(4thiazolyl)benzimidazole described in JP-A-63-257747, JP-A-62-272248 and JP-A-1-80941 are added to the color light sensitive materials of the present invention.

The present invention can be applied to various color light-sensitive materials. Typical examples of the color light-sensitive materials include general-purpose or movie color negative films, reversal color films for slide or TV, color paper, color positive films and reversal color paper.

Suitable supports which can be used in the present invention are described in the aforesaid *Research Disclosure* No. 17643 (page 28), ibid. No. 18716 (from right column of page 647 to left column of page 648) and ibid. No. 307105 (page 879).

The sum total of the layer thicknesses of the entire hydrophilic colloid of all the layers on the emulsion layer side of the light-sensitive material of the present invention is preferably not more than 28 μm, more preferably not more than 23 μm, still more preferably not more than 18 μm, particularly preferably not more than 16 μm. The layer swelling rate $T_{\frac{1}{2}}$ is preferably not more than 30 seconds, more preferably not more than 20 seconds. The layer thickness refers to a layer thickness obtained by making the measurement under moisture conditioning at 25° C. and 55% RH for 2 days. The layer swelling rate $T_{\frac{1}{2}}$ can be measured by conventional methods in the art. For example, the measurement can be made by using a swellometer of a type described in A. Green et al., *Photogra. Sci. Eng.*, Vol. 19, No.2, pp. 124–129. $T_{\frac{1}{2}}$ is defined as a time taken until the layer thickness reaches ½ of the saturated layer thickness when 90% of the maximum swollen layer thickness attainable by processing with a color developing solution at 30° C. for 3¼ minutes is referred to as the saturated film thickness.

The layer swelling rate $T_{\frac{1}{2}}$ can be controlled by adding gelatin as a binder or by changing conditions with time after coating. The swelling ratio is preferably 150 to 400%. The swelling ratio can be calculated from the maximum swollen layer thickness measured under the above conditions by the following formula:

$$\text{Swelling ratio} = (\text{Maximum swollen layer thickness} - \text{layer thickness})/\text{layer thickness}$$

It is preferred that the light-sensitive materials of the present invention are provided with a hydrophilic colloid layer (called back layer) having a dry thickness of 2 to 20 μm in total on the opposite side to the emulsion layer side. It is preferred that the back layer contains the aforesaid light absorber, filter dye, ultraviolet light absorber, antistatic agent, hardening agent, binder, plasticizer, lubricant, coating aid, surfactant, etc. The back layer has a swelling ratio of preferably 150 to 500%.

Color photographic materials according to the present invention can be developed by conventional methods described in the aforesaid *Research Disclosure* No. 17643, pp. 28–29, *Research Disclosure* No. 18716, left column to right column of page 615 and *Research Disclosure* No. 307105, pp. 880–881.

The color developing solutions which can be used in the processing of the light-sensitive materials of the present invention are preferably aqueous alkaline solutions mainly composed of aromatic primary amine color developing agents. Aninophenol compounds are useful as the color developing agents and p-phenylenediamine compounds are preferred as the color developing agents. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-α-methoxyethylaniline and salts thereof such as sulfate, hydrochloride and p-toluenesulfonate. These compounds may be used either alone or in combination of two or more of them.

Generally, the color developing solutions contain pH buffering agents such as alkali metal carbonates, borates and phosphates, development inhibitors such as chlorides, bromides, iodides, benzimidazoles, benzothiazoles and mercapto compounds and anti-fogging agents. If desired, the color developing solutions may optionally contain preservatives such as hydroxylamine, diethylhydroxylamine, sulfites, hydrazines such as N,N-biscarboxymethylhydrazine, phenylsemicarbazides, triethanolamine and catecholsulfonic acids; organic solvents such as ethylene glycol and diethylene glycol; development accelerators such as benzyl alcohol, polyethylene glycol, quaternary ammonium salts and amines; color forming couplers; competitive couplers, auxiliary developing agents such as 1-phenyl-3-pyrazolidone; tackifiers; and chelating agents such as aminopolycarboxylic acids, aminopolyphosphonic acids, alkylphosphonic acids and phosphonocarboxylic acids, for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N', N'-tetramethylenephosphonic acid and ethylenediamine-di(o-hydroxyphenylacetic acid) and salts thereof.

Generally, when reversal processing is to be conducted, black-and-white development is first carried out and color development is then carried out. Black-and-white developing solutions may contain conventional developing agents such as dihydroxybenzenes, ( e.g., hydroquinone), 3-pyrazolidones (e.g., 1-phenyl-3-pyrazolidone) and aminophenols ( e.g., N-methyl-p-aminophenol). These developing agents may be used either alone or in combination of two or more of them.

The pH of the color developing solutions and the black-and-white developing solutions is generally in the range of 9 to 12. The replenishment rate of these developing solutions varies depending on the types of the color photographic materials, but is usually not more than 3 l per $m^2$ of the photographic material. The replenishment rate can be reduced to 500 ml or less when the concentration of bromide ion in the replenisher is reduced. When the replenishment is to be reduced, it is desirable that the contact area of the processing solution with air in the processing bath is reduced to prevent the solution from being evaporated or oxidized by air.

The contact area of the photographic processing solution with air in the processing bath can be represented by an opening ratio defined as follows:

$$\text{Opening ratio} = [\text{contact area } (cm^2) \text{ of processing solution with air}] \div [\text{capacity } (cm^3) \text{ of processing solution}]$$

The Opening ratio is preferably not larger than 0.1, more preferably 0.001 to 0.05. Examples of methods for reducing the opening ratio include a method wherein a cover such as a floating cover is provided on the surface of the processing solution in the processing bath; a method using a movable cover as described in JP-A-1-82033; and a method involving slit development as described in JP-A-63-216050. It is preferred that the reduction of the opening ratio is applied to not only the color development stage and black-and-white development stage but also to all of the subsequent stages such as bleaching, bleach-fixing, fixing, rinsing and stabilization stages. The replenishment rate can be reduced by using a means for inhibiting the accumulation of bromide ion in the developing solution.

The color development time is generally set between 2 and 5 minutes, but the processing time can be shortened when the color developing agents are used at a higher concentration under higher temperature and higher pH conditions.

After color development, the photographic emulsion layer is generally bleached. Bleaching may be carried out simultaneously with fixing (bleach-fixing treatment) or bleaching and fixing may be separately carried out. After bleaching, a bleach-fixing treatment may be conducted to expedite processing. Processing may be conducted with a bleach-fixing bath composed of two consecutive baths. Fixing may be conducted before the bleach-fixing treatment. After the bleach-fixing treatment, bleaching may be conducted according to the intended purpose. Examples of bleaching agents include compounds of polyvalent metals such as iron(III), cobalt(III), peracids, quinones and nitro compounds. Typical examples of the bleaching agents include organic complex salts of iron(III) such as complex salts of aminopolycarboxylic acids (e.g., ethylenediaminetetraacetic acid, diethylenetriaminepentaacetic acid cyclohexanediamine-tetraacetic acid, methyliminodiacetic acid, 1,3-diaminopropanetetraacetic acid, glycol ether diaminetetraacetic acid, etc.) citric acid, tartaric acid, malic acid, etc. Among them, iron(III) complex salts of aminopolycarboxylic acids such as (ethylenediaminetetraacetato) iron(III) complex and (1,3-diaminopropanetetraacetato) iron(III) complex are preferred from the viewpoints of rapid processing and prevention of environmental pollution. Further, iron(III) complex salts of aminopolycarboxylic acids are useful for bleaching solutions and bleach-fixing solutions. The pH of the bleaching solutions containing the iron(III) complex salts of the aminopolycarboxylic acids and the bleach-fixing solutions containing said iron(III) complex salts is generally in the range of 4.0 to 8. A lower pH may be used to expedite processing.

If desired, the bleaching solution, the bleach-fixing solution and a prebath thereof may contain bleaching accelerators. Examples of the useful bleaching accelerators include compounds having a mercapto group or a disulfide group described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-28426 and *Research Disclosure* No. 17129 (July 1978 ); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 996,410 and 2,748,430; polyamine compounds described in JP-B-45-8836; compounds described in JP-A-49-40943, JP-A-49-59644, JP-A-53-94927, JP-A-54and JP-A-58-163940; and bromide ions. Among them, the compounds having a mercapto group or a disulfide group are preferred from the viewpoint of high accelerating effect. Particularly, the compounds described in U.S. Pat. No. 3,893,858, West German Patent 1,290,812 and JP-A53-95630 are preferred. Further, the compounds described in U.S. Pat. No. 4,552,834 are preferred. These bleaching accelerators may be incorporated in the photographic materials. These bleaching accelerators are particularly effective in conducting the bleach-fixing of the color photographic materials for photographing.

It is preferred that the bleaching solution and the bleach-fixing solution contain, in addition to the above-described compounds, organic acids to prevent bleach stain from being formed. Particularly preferred organic acids are compounds having an acid dissociation constant (pKa) of 2 to 5. Specific examples of such organic acids include acetic acid, propionic acid and hydroxyacetic acid.

Examples of fixing agents which are used in the fixing solutions and the bleach-fixing solutions include thiosulfates, thiocyanates, thioether compounds, thioureas and various iodides. The thiosulfates are widely used. Particularly, ammonium thiosulfate is most widely used. Further, the combinations of the thiosulfates with the thiocyanates, the thioether compounds or thiourea are preferred. Sulfites, bisulfites, carbonyl bisulfites adducts or sulfinic acid compounds described in European Patent 294,769A are preferred as preservatives for the fixing solutions or the bleach-fixing solutions. It is preferred that aminopolycarboxylic acids or organophosphonic acids are added to the fixing solutions or the bleach-fixing solutions to stabilize the solutions.

It is preferred that compounds having a pKa of 6.0 to 9.0 such as preferably imidazoles (e.g., imidazole, 1-methylimidazole, 1-ethylimidazole, 2-methylimidazole) in an amount of 0.1 to 10 mol/l are added to the fixing solutions or to the bleach-fixing solutions to adjust the pH.

A shorter total desilverization time is preferable, so long as a failure in desilverization is not caused. The desilverization time is preferably 1 to 3 minutes, more preferably 1 to 2 minutes. The processing temperature is 25° to 50° C. preferably 35° to 45° C. The desilverization rate is improved within the preferred temperature range mentioned above, and stain can be effectively prevented from being formed after processing.

It is preferred that stirring in the desilverization stage is intensified as much as possible. Specific examples of methods for intensifying stirring include a method wherein a jet stream of a processing solution is allowed to collide with the surface of the emulsion layer of the light-sensitive material as described in JP-A-62-183460; a method wherein a stirring effect is improved by using a rotating means as described in JP-A-62-183461; a method wherein while a wiper blade provided in the solution is brought into contact with the surface of the emulsion layer, the light-sensitive material is transferred to thereby form a turbulent flow on the surface of the emulsion layer, whereby a stirring effect can be improved; and a method wherein a circulating flow rate of the processing solution as a whole is increased. Such means for improving stirring is effective for stirring any of the bleaching solution, the bleach-fixing solution and the fixing solution. It is thought that an improvement in stirring enables the introduction of the bleaching agent and the fixing agent into the emulsion layer to be expedited and as a result, the desilverization rate can be increased. The above means for improving stirring is more effective when the bleaching accelerators are used. An accelerating effect can be greatly increased, and a problem of inhibiting fixation due to the bleaching accelerator can be solved.

It is preferred that automatic processors for use in the processing of the light-sensitive materials of the present invention are provided with a means for conveying the light-sensitive materials as described in JP-A-60-191257, JP-A-60-191258 and JP-A-60-191259. Such conveying means enables the amount of the processing solution brought over from the prebath to a subsequent bath to be greatly reduced, and hence the conveying means has a remarkable effect of preventing the performance of the processing solution from being deteriorated. Such effect is particularly effective in shortening the processing time in each stage and reducing the replenishment rate of each processing solution.

Usually, the silver halide color photographic materials of the present invention are subjected to a washing and/or stabilization stage after desilverization. The amount of rinsing water in the washing stage varies widely depending on the characteristics (e.g., depending on materials used such as couplers) of the photographic materials, use, the temperature of the rinsing water, the number of rinsing tanks (the number of stages ), the replenishing system ( countercurrent, direct flow) and other conditions. The relationship between the amount of water and the number of rinsing tanks in the multi-stage countercurrent system can be determined by the method described in *Journal of the Society of Motion Picture and Television Engineers,* Vol. 64, p. 248–253 (May 1955). According to the multi-stage countercurrent system described in the above literature, the amount of rinsing water can be greatly reduced. However, there is caused a problem that the residence time of water in the tanks is prolonged and as a result, bacteria are grown and the resulting suspended material is deposited on the photographic material. A method for reducing calcium ions and magnesium ions described in JP-A-62-288838 can be effectively used for the color photographic materials of the present invention to solve the above-mentioned problem. Further, isothiazolone compounds, thiabendazole compounds, chlorine-containing antimicrobial agents such as sodium chlorinated isocyanurate and benztriazole described in JP-A-57-8542 and antimicrobial agents described in Chemistry of Antibacterial and Antifungal Agent, written by Hiroshi Horiguchi (1986), Sterilization, Disinfection, Antifungal Technique, edited by Sanitary Technique Society ( 1982 ) and Antibacterial and Antifungal cyclopedie, edited by Nippon Antibacterial Antifungal Society ( 1986 ), can be used.

The pH of the rinsing water in the treatment of the photographic materials of the present invention is in the range of 4 to 9, preferably 5 to 8. The temperature of the rinsing water and the washing time vary depending on the characteristics of the photographic materials, use, etc., but the temperature and time of washing are generally 15° to 45° C. for 20 seconds to 10 minutes, preferably 25° to 40° C. for 30 seconds to 5 minutes. The photographic materials of the present invention may be processed directly with stabilizing solutions in place of said rinsing water. Such stabilizing treatment can be carried out by conventional methods as described in JP-A-57-8543, JP-A-58-14834 and JP-A-60-220345.

The stabilizing treatment subsequent to the rinsing may be conducted. The stabilizing treatment may be used as the final bath for the color photographic materials for photographing. An example thereof includes a stabilizing bath containing a dye stabilizer and a surfactant. Examples of the dye stabilizer include aldehydes such as formaldehyde and glutaraldehyde, N-methylol compounds, hexamethylenetetramine and aldehyde sulfite adducts. The stabilizing bath may contain various chelating agents and antifungal agents.

Overflow solution from the replenishment of rinsing water and/or stabilizing solution can be reused in other stages such as in the desilverization stage.

When each processing solution is concentrated by evaporation in a process using the automatic processor, etc., it is preferred that the concentration of each processing solution is corrected by adding water.

The color developing agents may be incorporated in the silver halide color photographic materials of the present invention for the purpose of simplifying and expediting processing. It is preferred that precursors for the color developing agents are used by the incorporation thereof in the photographic materials. Examples of the precursors include indoaniline compounds described in U.S. Pat. No. 3,342,597; Schiff base type compounds described in U.S. Pat. No. 3,342,599 *Research Disclosure* No. 14850 and ibid., No. 15159; aldol compounds described in *Research Disclosure* No. 13924; metal complex salts described in U.S. Pat. No. 3,719,492; and urethane compounds described in JP-A-53-135628.

If desired, 1-phenyl-3-pyrazolidones may be incorporated in the silver halide color photographic materials of the present invention for the purpose of accelerating color development. Typical examples of the compounds include those described in JP-A-56-64339, JP-A-57-144547 and JP-A-58-115438.

In the present invention, various processing solutions are used at a temperature of 10° to 50° C. Generally, a temperature of 33° to 38° C. is used. However, it is possible that a higher temperature is used to accelerate processing and to shorten processing time, while a lower temperature is used to improve image quality and to improve the stability of the processing solutions.

The silver halide light-sensitive materials of the present invention can be applied to heat developing light-sensitive materials as described in U.S. Pat. No. 4,500,626, JP-A-60-133449, JP-A-59-218443, JP-A-61-238056 and European Patent 210,660A2.

The present invention is now illustrated in greater detail by reference to the following examples which, however, are not to be construed as limiting the invention in any way.

EXAMPLE 1

Preparation of sample 101

An undercoated cellulose triacetate film support of 127 μm in thickness was coated with the following layers having the following compositions to prepare a multi-layer color light-sensitive material as sample 101. Numerals represent coating amounts per $m^2$. The effects of compounds added are not limited to the uses described below.

| | |
|---|---|
| First layer: Antihalation Layer | |
| Black colloidal silver | 0.20 g |
| Gelatin | 1.9 g |
| Ultraviolet absorber U-1 | 0.04 g |
| Ultraviolet absorber U-2 | 0.1 g |
| Ultraviolet absorber U-3 | 0.1 g |
| Ultraviolet absorber U-4 | 0.1 g |
| Ultraviolet absorber U-6 | 0.1 g |
| High-boiling point organic solvent Oil-1 | 0.1 g |
| Dispersion of microcrystalline solid of dye E-1 | 0.1 g |
| Second layer: Interlayer | |
| Gelatin | 0.40 g |
| Compound Cpd-D | 5 mg |
| Compound Cpd-L | 5 mg |
| Compound Cpd-M | 3 mg |
| High-boiling point organic solvent Oil-3 | 0.1 g |
| Dye D-4 | 0.4 mg |
| Third layer: Interlayer | |
| Fine grain silver iodobromide emulsion wherein the surfaces and interiors of grains were fogged (mean grain size: 0.06 μm, a coefficient of variation: 18%, AgI content: 1 mol %) | 0.05 g as Ag |
| Gelatin | 0.4 g |
| Fourth layer: Low-sensitivity Red-sensitive Emulsion Layer | |
| Emulsion A | 0.1 g as Ag |
| Emulsion B | 0.4 g as Ag |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-D | 10 mg |
| High boiling point organic solvent Oil 2 | 0.1 g |
| Fifth layer: Intermediate-sensitivity Red-sensitive Emulsion Layer | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| Coupler C-9 | 0.05 g |
| High-boiling point organic solvent Oil-2 | 0.1 g |
| Sixth layer: High-sensitivity Red-sensitive Emulsion Layer | |
| Emulsion D | 0.4 g as Ag |
| Gelatin | 1.1 g |
| Coupler C-1 | 0.3 g |
| Coupler C-2 | 0.1 g |
| Coupler C-3 | 0.7 g |
| Coupler C-9 | 0.1 g |
| Additive P-1 | 0.1 g |
| Seventh layer: Interlayer | |
| Gelatin | 0.6 g |
| Additive M-1 | 0.3 g |
| Color mixing inhibitor Cpd-K | 2.6 mg |
| Ultraviolet absorber U-1 | 0.1 g |
| Ultraviolet absorber U-6 | 0.1 g |
| Dye D-1 | 0.02 g |
| Compound Cpd-D | 5 mg |
| Compound Cpd L | 5 mg |

-continued

| | |
|---|---|
| Compound Cpd-M | 5 mg |
| Eighth layer: Interlayer | |
| Silver iodobromide emulsion wherein the surfaces and interiors of grains were fogged (mean grain size: 0.06 μm, a coefficient of variation: 16%, AgI content: 0.3 mol %) | 0.02 g as Ag |
| Gelatin | 1.0 g |
| Additive P-1 | 0.2 g |
| Color mixing inhibitor Cpd-N | 0.1 g |
| Color mixing inhibitor Cpd-A | 0.1 g |
| Ninth layer: Low-sensitivity Green-sensitive Emulsion Layer | |
| Emulsion E | 0.1 g as Ag |
| Emulsion F | 0.2 g as Ag |
| Emulsion G | 0.2 g as Ag |
| Gelatin | 0.5 g |
| Coupler C-4 | 0.05 g |
| Coupler C-7 | 0.05 g |
| Coupler C-8 | 0.20 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| High-boiling point organic solvent Oil-1 | 0.1 g |
| High-boiling point organic solvent Oil-2 | 0.2 g |
| Tenth layer: Intermediate sensitivity Green-sensitive Emulsion Layer | |
| Emulsion G | 0.3 g as Ag |
| Emulsion H | 0.1 g as Ag |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High-boiling point organic solvent Oil-2 | 0.01 g |
| Eleventh layer: High-sensitivity Green-sensitive Emulsion Layer | |
| Emulsion I | 0.5 g as Ag |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High-boiling point orgainc solvent Oil-1 | 0.02 g |
| High-boiling point organic solvent Oil-2 | 0.02 g |
| Twelfth layer: Interlayer | |
| Gelatin | 0.6 g |
| Dye D-1 | 0.1 g |
| Dye D-2 | 0.05 g |
| Dye D-3 | 0.07 g |
| Thirteenth layer: Yellow Filter Layer | |
| Yellow colloidal silver | 0.07 g as Ag |
| Gelatin | 1.1 g |
| Color mixing inhibitor Cpd-A | 0.01 g |
| High-boiling point organic solvent Oil-1 | 0.01 g |
| Dispersion of microcrystalline solid of dye E-2 | 0.05 g |
| Fourteenth layer: Interlayer | |
| Gelatin | 0.6 g |
| Fifteenth layer: Low-sensitivity Blue-sensitive Emulsion Layer | |
| Emulsion J | 0.2 g as Ag |
| Emulsion K | 0.3 g as Ag |
| Emulsion L | 0.1 g as Ag |
| Gelatin | 0.8 g |
| Coupler C-5 | 0.3 g |
| Coupler C-6 | 0.3 g |
| Sixteenth layer: Intermediate-sensitivity Blue-sensitive Emulsion Layer | |
| Emulsion L | 0.1 g as Ag |

-continued

| | |
|---|---|
| Emulsion M | 0.4 g as Ag |
| Gelatin | 0.9 g |
| Coupler C-5 | 0.3 g |
| Coupler C-6 | 0.3 g |
| Seventeenth layer: High sensitivity Blue-sensitive Emulsion Layer | |
| Emulsion N | 0.4 g as Ag |
| Gelatin | 1.2 g |
| Coupler C-5 | 0.1 g |
| Coupler C-6 | 0.6 g |
| Eighteenth layer: First Protective Layer | |
| Gelatin | 0.7 g |
| Ultraviolet absorber U-1 | 0.04 g |
| Ultraviolet absorber U-2 | 0.01 g |
| Ultraviolet absorber U-3 | 0.03 g |
| Ultraviolet absorber U-4 | 0.03 g |
| Ultraviolet absorber U-5 | 0.05 g |
| Ultraviolet absorber U-6 | 0.05 g |
| High-boiling point organic solvent Oil-1 | 0.02 g |
| Formalin scavenger | |
| Cpd-C | 0.2 g |
| Cpd-I | 0.4 g |
| Dye D 3 | 0.05 g |
| Compound Cpd-N | 0.02 g |
| Nineteenth layer: Second Protective Layer | |
| Colloidal silver | 0.1 mg as Ag |
| Fine grain silver iodobromide emulsion (mean grain size: 0.06 μm, AgI content: 1 mol %) | 0.1 g as Ag |
| Gelatin | 0.4 g |
| Twentieth layer: Third Protective Layer | |
| Gelatin | 0.4 g |
| Polymethyl methacrylate (average particle size: 1.5 μm) | 0.1 g |
| Methyl methacrylate/acrylic acid (4:6) copolymer (average particle size: 1.5 μm) | 0.1 g |
| Silicone oil | 0.03 g |
| Surfactant W-1 | 3.0 mg |
| Surfactant W-2 | 0.03 g |

In addition to the above-described ingredients, additives F-1 to F-8 were added to all of the emulsion layers. Further, a hardening agent H-1 for gelatin and surfactants W-3, W-4, W-5, W-6 and W-7 for coating and emulsifying in addition to the above-described ingredients were added to each layer.

Furthermore, phenol, 1,2-benzisothiazoline-3-one, 2-phenoxyethanol and phenethyl alcohol were added as antiseptics and antifungal agents.

TABLE 8

Silver iodobromide emulsion used in sample 101

| | Type of Emulsion | Mean Grain Size in terms of a Sphere (μm) | Coefficient of Variation (%) | AgI Content (%) |
|---|---|---|---|---|
| A | Monodisperse tetra-decahedral grains | 0.28 | 16 | 3.7 |
| B | Monodisperse cubic internal latent image type grains | 0.30 | 10 | 3.3 |
| C | Monodisperse tabular grains, average aspect ratio: 4.0 | 0.38 | 18 | 5.0 |
| D | Monodisperse tabular grains, average aspect ratio: 7.0 | 0.68 | 25 | 2.0 |
| E | Monodisperse cubic grains | 0.20 | 17 | 4.0 |
| F | Monodisperse cubic grains | 0.23 | 16 | 4.0 |
| G | Monodisperse cubic internal latent image type grains | 0.28 | 11 | 3.5 |
| H | Monodisperse cubic internal latent image type grains | 0.32 | 9 | 3.5 |
| I | Monodisperse tabular | 0.80 | 28 | 1.5 |

TABLE 8-continued

| Silver iodobromide emulsion used in sample 101 | | | | |
|---|---|---|---|---|
| | Type of Emulsion | Mean Grain Size in terms of a Sphere (μm) | Coefficient of Variation (%) | AgI Content (%) |
| | grains, average aspect ratio: 7.0 | | | |
| J | Monodisperse tetra-decahedral grains | 0.30 | 18 | 4.0 |
| K | Monodisperse tabular grains, average aspect ratio: 7.0 | 0.45 | 17 | 4.0 |
| L | Mondisperse cubic internal latent image type grains | 0.46 | 14 | 3.5 |
| M | Monodisperse tabular grains, average aspect ratio: 7.0 | 0.55 | 13 | 4.0 |
| N | Mondisperse tabular grains, average aspect ratio: 7.0 | 1.00 | 33 | 1.3 |

TABLE 9

| Spectral sensitization of emulsions A to N | | | |
|---|---|---|---|
| Type of Emulsion | Sensitizing Dye added | Amount (g) added per mol of Silver Halide | Stage where Sensitizing Dye was added |
| A | S-1 | 0.025 | immediately after chemical sensitization |
| | S-2 | 0.25 | immediately after chemical sensitization |
| B | S-1 | 0.01 | immediately after completion of formation of grains |
| | S-2 | 0.25 | immediately after completion of formation of grains |
| C | S-1 | 0.02 | just before initiation of chemical sensitization |
| | S-2 | 0.25 | just before initiation of chemical sensitization |
| D | S-1 | 0.01 | immediately after chemical sensitization |
| | S-2 | 0.10 | immediately after chemical sensitization |
| | S-7 | 0.01 | immediately after chemical sensitization |
| E | S-3 | 0.5 | immediately after chemical sensitization |
| | S-4 | 0.1 | immediately after chemical sensitization |
| F | S-3 | 0.3 | immediately after chemical sensitization |
| | S-4 | 0.1 | immediately after chemical sensitization |
| G | S-3 | 0.25 | immediately after completion of formation of grains |
| | S-4 | 0.08 | immediately after completion of formation of grains |
| H | S-3 | 0.2 | during formation of grains |
| | S-4 | 0.06 | during formation of grains |
| I | S-3 | 0.3 | just before initiation of chemical sensitization |
| | S-4 | 0.07 | just before initiation of chemical sensitization |
| | S-8 | 0.1 | just before initiation of chemical sensitization |
| J | S-6 | 0.2 | during formation of grains |
| | S-5 | 0.05 | during formation of grains |
| K | S-6 | 0.2 | just before initiation of chemical sensitization |
| | S-5 | 0.05 | just before initiation of chemical sensitization |
| L | S-6 | 0.22 | immediately after completion of formation of grains |
| | S-5 | 0.06 | immediately after completion of formation of grains |
| M | S-6 | 0.15 | just before initiation of chemical sensitization |
| | S-5 | 0.04 | just before initiation of chemical sensitization |
| N | S-6 | 0.22 | immediately after completion of formation of grains |
| | S-5 | 0.06 | immediately after completion of formation of grains |

The compounds used in the sample 101 had the following structures.

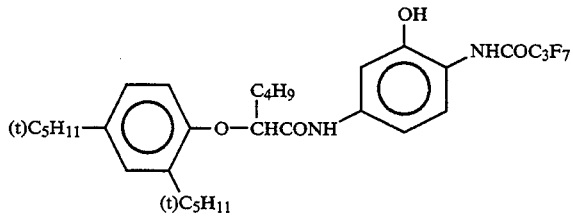

C-1

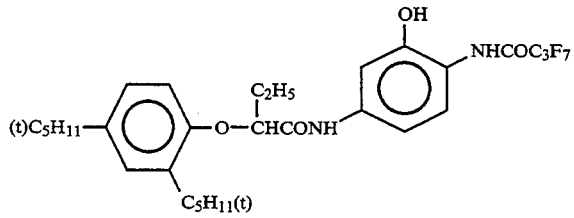

C-2

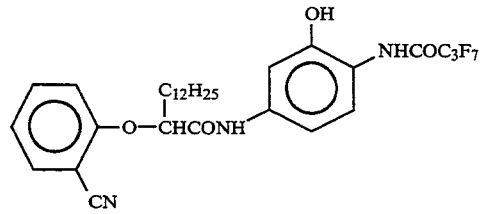

C-3

-continued
C-4
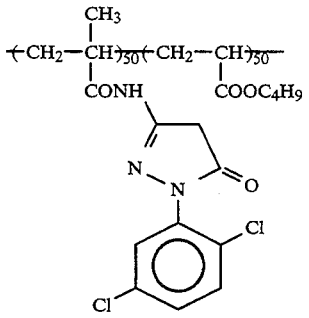
Numerals are wt %.
Average MW: about 25,000
C-5
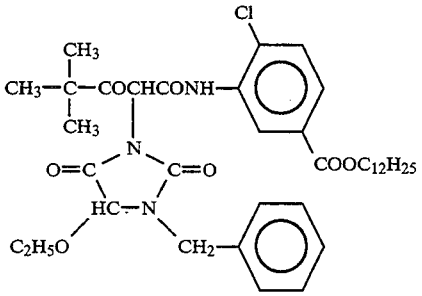
C-6
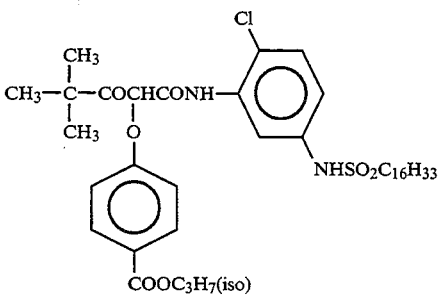
C-7
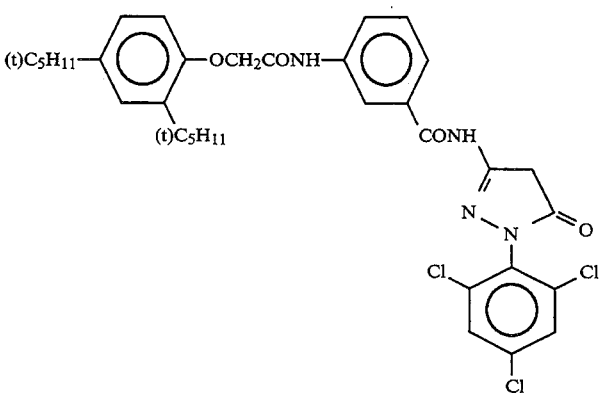

-continued
C-8
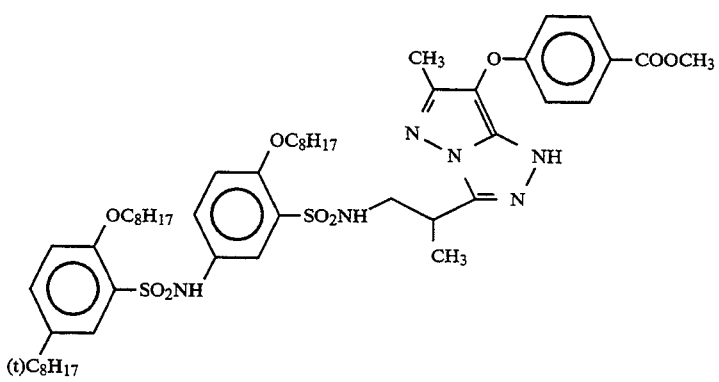
C-9
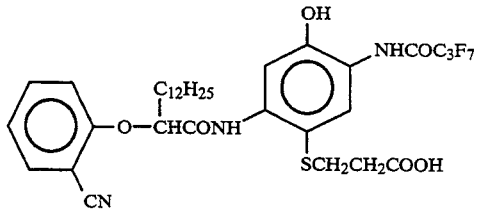
Dibutyl phthalate — Oil-1
Tricresyl phosphate — Oil-2
Oil-3
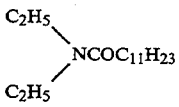
Cpd-A
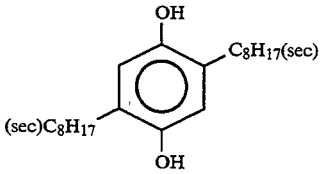
Cpd-B
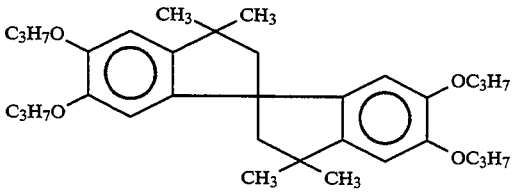
Cpd-C
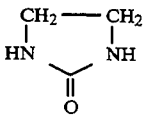
Cpd-D
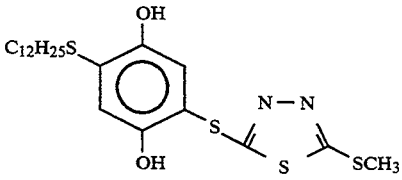

-continued
Cpd-E
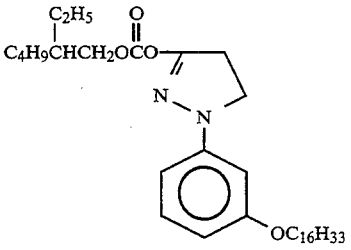
Cpd-F
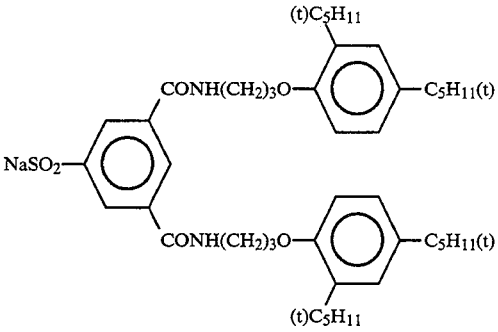
Cpd-G
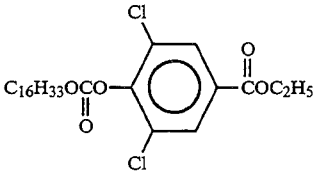
Cpd-H
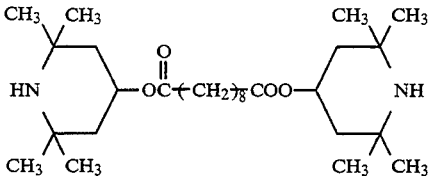
Cpd-I
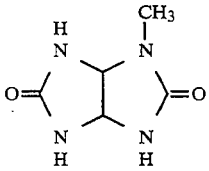
Cpd-K
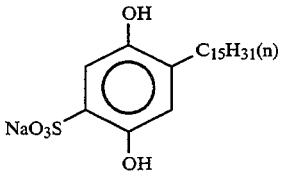
Cpd-L
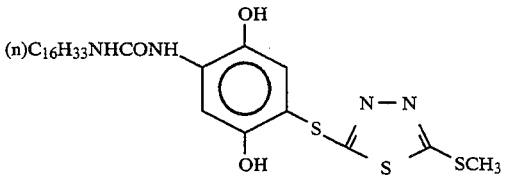
Cpd-M
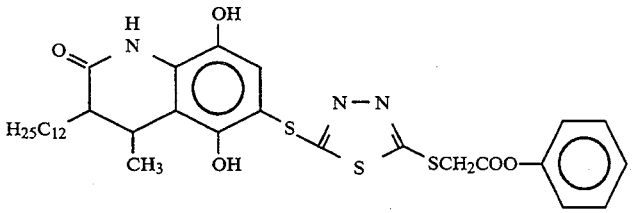

-continued
Cpd-N
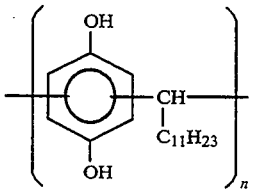
Average Molecular Weight: 9000
U-1
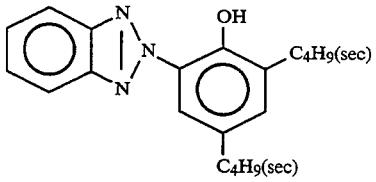
U-2
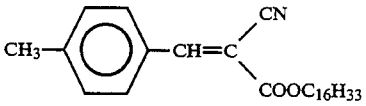
U-3
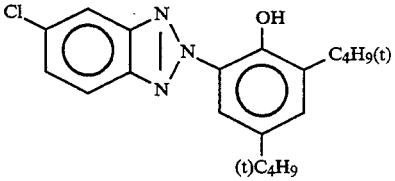
U-4
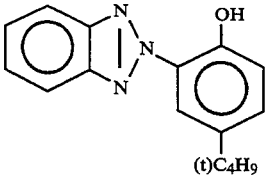
U-5
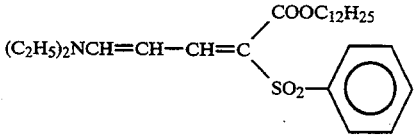
U-6
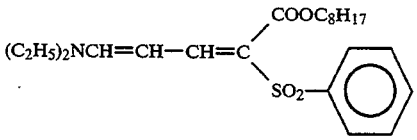
S-1
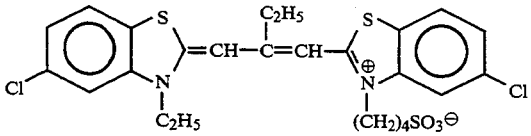

-continued
S-2
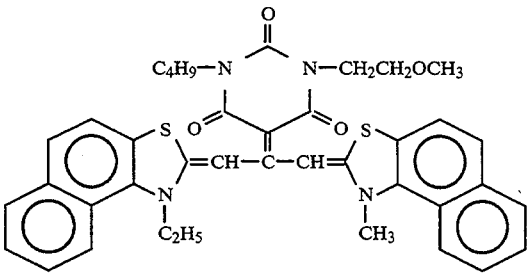
S-3
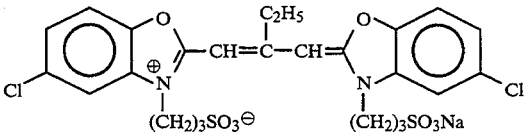
S-4
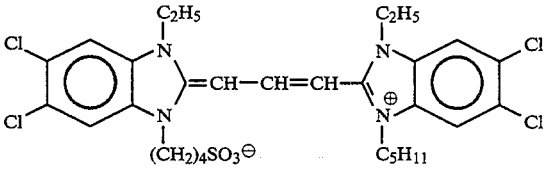
S-5
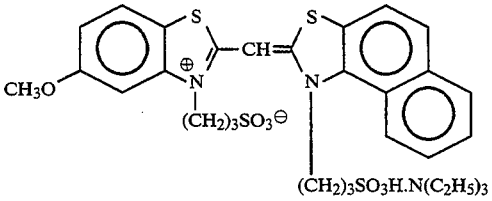
S-6
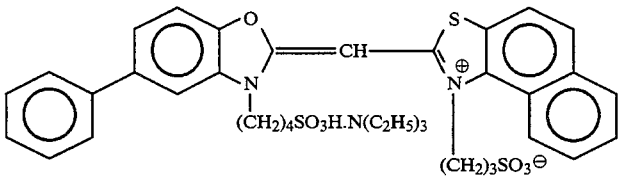
S-7
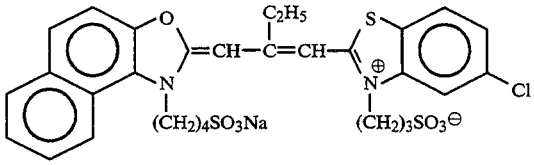
S-8
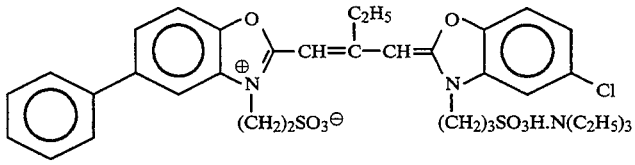
D-1
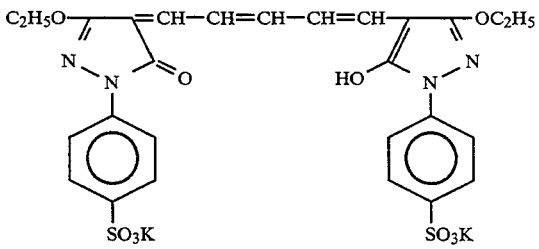

-continued
D-2
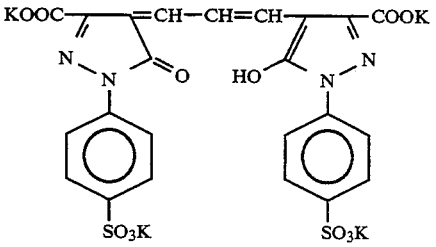
D-3
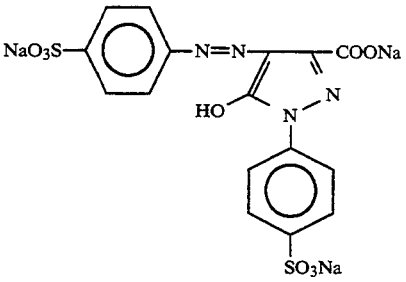
D-4
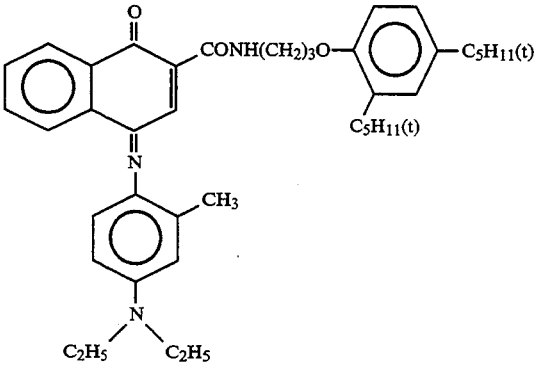
E-1
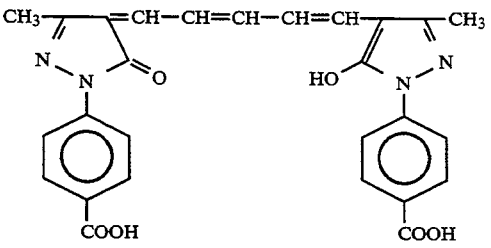
E-2
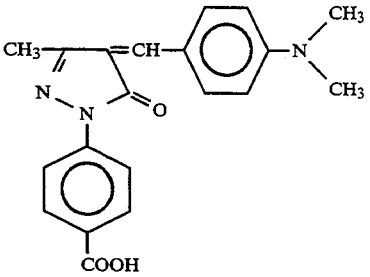
H-1
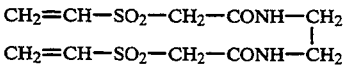

-continued
W-1
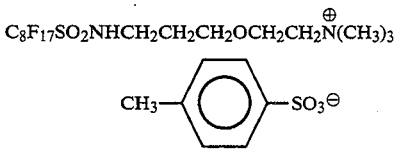
W-2
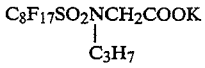
W-3
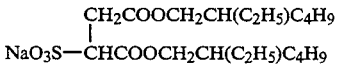
W-4
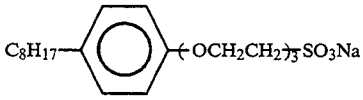
W-5
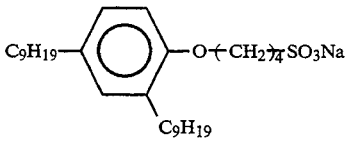
W-6
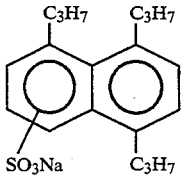
W-7
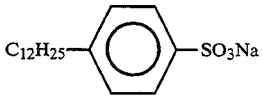
P-1
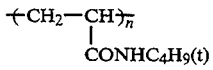
M-1
F-1
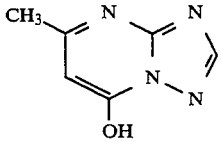
F-2
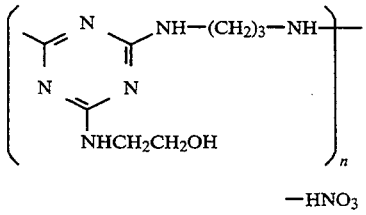
F-3
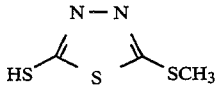

-continued

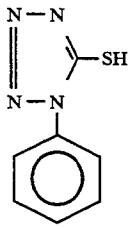

F-4

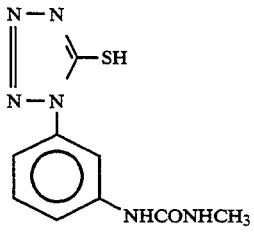

F-5

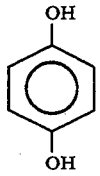

F-6

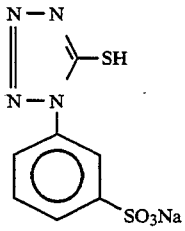

F-7

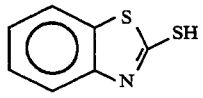

F-8

Preparation of samples 102 to 111

Samples 102 to 111 were prepared in the same manner as in the preparation of sample 101 except that an equimolar amount of each of the compounds of the present invention and comparative compounds indicated in Table 10 was used in the place of each of the couplers used in the 15th, 16th and 17th layers of sample 101.

TABLE 10

| Sample | Yellow Coupler used in the 15th Layer | Yellow Coupler used in the 16th Layer | Yellow Coupler used in the 17th Layer |
|---|---|---|---|
| 101 (Comp. Ex.) | C-5 | C-5<br>C-6 | C-6 |
| 102 (Comp. Ex.) | C-5 | I-2 | I-2 |
| 103 (Comp. Ex.) | I-5 | I-2 | C-6 |
| 104 (Comp. Ex.) | I-3 | I-3<br>I-4 | I-4 |
| 105 (Invention) | C-5 | C-5<br>Y-2 | Y-2 |
| 106 (Invention) | I-6 | Y-7 | Y-7 |
| 107 (Invention) | Y-42 | C-6 | Y-42 |
| 108 (Invention) | I-7<br>Y-4 | I-7<br>Y-4 | Y-28 |
| 109 (Invention) | Y-7 | Y-7 | I-4 |
| 110 (Invention) | I-9 | Y-52 | Y-30 |

TABLE 10-continued

| Sample | Yellow Coupler used in the 15th Layer | Yellow Coupler used in the 16th Layer | Yellow Coupler used in the 17th Layer |
|---|---|---|---|
| 111 (Invention) | Y-14<br>I-6 | Y-30<br>Y-14<br>I-6 | Y-14<br>I-6 |

The graininess of the yellow dye images of these samples was judged by the conventional RMS (Root Mean Square) method. The judgement of graininess by the RMS method is known to those skilled in the art and is described in the section entitled "RMS Granularlity: Determination of Just noticeable difference" in *Photographic Science and Engineering,* Vol. 19, No. 4 (1975), pp. 235–238.

RMS values at a density of 0.3 and 1.0 are shown in Table 11.

Further, samples 101 to 111 were exposed, developed and stored under constant temperature and constant humidity conditions of 80° C. and 70% for one week. The ratio of yellow density after storage to yellow density immediately after development was determined. The results are shown in Table 11.

TABLE 11

| Sample | RMS Value D = 0.3 | RMS Value D = 1.0 | Dye preservability Dye Residual Ratio |
|---|---|---|---|
| 101 (Comp. Ex.) | 0.0195 | 0.0140 | 0.70 |
| 102 (Comp. Ex.) | 0.0204 | 0.0144 | 0.75 |
| 103 (Comp. Ex.) | 0.0200 | 0.0139 | 0.74 |
| 104 (Comp. Ex.) | 0.0202 | 0.0141 | 0.81 |
| 105 (Invention) | 0.0178 | 0.0124 | 0.89 |
| 106 (Invention) | 0.0176 | 0.0124 | 0.90 |
| 107 (Invention) | 0.0181 | 0.0126 | 0.91 |
| 108 (Invention) | 0.0177 | 0.0125 | 0.90 |
| 109 (Invention) | 0.0174 | 0.0122 | 0.93 |
| 110 (Invention) | 0.0165 | 0.0125 | 0.93 |
| 111 (Invention) | 0.0175 | 0.0124 | 0.92 |

The above-described development and processing were carried out in the following stages.

| Stage | Processing Stage Time (min) | Temp. (°C.) | Tank capacity (l) | Amount of Replenisher (l/m²) |
|---|---|---|---|---|
| Black-and-white development | 6 | 38 | 12 | 2.2 |
| First rinsing | 2 | 38 | 4 | 7.5 |
| Reversal | 2 | 38 | 4 | 1.1 |
| Color development | 6 | 38 | 12 | 2.2 |
| Compensating | 2 | 38 | 4 | 1.1 |
| Bleaching | 6 | 38 | 12 | 0.22 |
| Fixing | 4 | 38 | 8 | 1.1 |
| Second rinsing | 4 | 38 | 8 | 7.5 |
| Stabilization | 1 | 25 | 2 | 1.1 |

Each processing solution had the following composition.

| Black-and-white developing solution | Mother solution | Replenisher |
|---|---|---|
| Pentasodium nitrilo-N,N,N-trimethylenephosphonate | 2.0 g | 2.0 g |
| Sodium sulfite | 30 g | 30 g |
| Potassium hydroquinone-monosulfonate | 20 g | 20 g |
| Potassium carbonate | 33 g | 33 g |
| 1-Phenyl-4-methyl-4-hydroxy-methyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Add water to make | 1000 ml | 1000 ml |
| pH | 9.60 | 9.60 |

The pH was adjusted by hydrochloric acid or potassium hydroxide.

Reversal solution
Mother solution and replenisher being the same.

| | |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Add water to make | 1000 ml |
| pH | 6.00 |

The pH was adjusted by hydrochloric acid or sodium hydroxide.

| Color developing solution | Mother solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate dodeca-hydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-(β-methanesulfonamido-ethyl)-3-methyl-4-aminoaniline sulfate | 11 g | 11 g |
| 3,5-Dithia-1.8-octanediol | 1.0 g | 1.0 g |
| Add water to make | 1000 ml | 1000 ml |
| pH | 11.80 | 12.00 |

The pH was adjusted by hydrochloric acid or potassium hydroxide.

Compensating solution
Mother solution and replenisher being the same.

| | |
|---|---|
| Disodium ethylenediaminetetraacetate dihydrate | 8.0 g |
| Sodium sulfite | 12 g |
| 1-Thioglycerin | 0.4 ml |
| Sorbitan ester | 0.1 g |

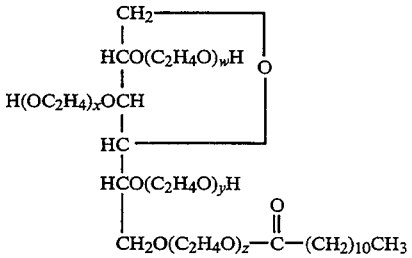

(w + x + y + z = 20)

| | |
|---|---|
| Add water to make | 1000 ml |
| pH | 6.20 |

The pH was adjusted by hydrochloric acid or sodium hydroxide.

Bleaching solution

| | Mother solution | Replenisher |
|---|---|---|
| Disodium ethylenediaminetetra-acetate dihydrate | 2.0 g | 4.0 g |
| Ammonium ethylenediamine-tetraacetato ferrate dihydrate | 120 g | 240 g |
| Potassium bromide | 100 g | 200 g |
| Ammonium nitrate | 10 g | 20 g |
| Add water to make | 1000 ml | 1000 ml |
| pH | 5.70 | 5.50 |

The pH was adjusted by hydrochloric acid or sodium hydroxide.

Fixing solution
Mother solution and replenisher being the same.

| | |
|---|---|
| Ammonium thiosulfate | 8.0 g |
| Sodium sulfite | 5 0 g |
| Sodium bisulfite | 5.0 g |
| Add water to make | 1000 ml |

-continued

| Fixing solution<br>Mother solution and replenisher being the same. | |
|---|---|
| pH | 6.60 |

The pH was adjusted by hydrochloric acid or ammonia water.

| Stabilizing solution<br>Mother solution and replenisher being the same. | |
|---|---|
| Formalin (37%) | 5.0 ml |
| Polyoxyethylene p-monononylphenyl ether (degree of polymerization: 10) | 0.5 ml |
| Add water to make | 1000 ml |
| pH | not adjusted |

It is apparent from Table 11 that the samples of the present invention are excellent in graininess as well as in dye image preservability.

EXAMPLE 2

Sample A is prepared in the same manner as in the preparation of sample 201 of Example 2 of JP-A-2-90151 except that an equimolar amount of the coupler I-2 is used in place of the Coupler Cp-N used in the 10th layer of the sample 201 and an equimolar amount of the coupler Y-7 of the present invention is used in place of the coupler Cp-N used in the 10th layer of the sample 201. Sample A is tested in the same manner as in Example 1, and favorable results similar to those of Example 1 are obtained.

EXAMPLE 3

Sample B is prepared in the same manner as in the preparation of the color photographic material of Example 2 of JP-A-l-158434 except that an equimolar amount of the coupler I-2 of present invention is used in place of the coupler ExY-1 used in the 11th layer of the color photographic material of Example 2 of JP-A-1-158434, and an equimolar amount of the coupler Y-28 of the present invention is used in place of the coupler ExY-1 used in the 12th layer thereof. Sample B is tested in the same manner as in Example 1, and favorable results similar to those of Example 1 are obtained.

EXAMPLE 4

Sample C is prepared in the same manner as in the preparation of the sample No. 1 of Example 1 of JP-A-2-90145 except that an equimolar amount of each of the couplers I-4 and Y-28 of the present invention are used in place of each of the couplers ExY-1 and 2 used in the 11th and 12th layers of the sample No. 1 of Example 1 of JP-A-2-90145. Sample C is tested in the same manner as in Example 1, and favorable results similar to those of Example 1 are obtained.

EXAMPLE 5

Sample D is prepared in the same manner as in the preparation of the sample No. 214 of Example 2 of JP-A-2-139544 except that an equimolar amount of the coupler Y-54 of the present invention is used in place of the yellow coupler ExY of sample No. 214. Sample D is tested in the same manner as in Example 1, and favorable results-similar to those of Example 1 are obtained.

The object of the present invention is to provide a color photographic material which is excellent in graininess as well as in dye image preservability.

The present invention provides a silver halide color photographic material containing a malondiamide type yellow coupler and a pivaloylacetanilide type yellow coupler.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one blue-sensitive silver halide emulsion layer, wherein said blue-sensitive silver halide emulsion layer contains at least one yellow dye-forming coupler of the following general formula (2):

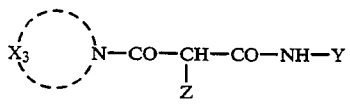

(2)

wherein $X_3$ represents an organic residue which forms a nitrogen-containing heterocyclic group together with >N—; Y represents an aryl group or a heterocyclic group; and Z represents a 5—or 6—membered nitrogen-containing heterocyclic group which is bonded at the coupling position through a nitrogen atom, or a 5—or 6—membered heterocyclic thio group; and at least one yellow dye forming coupler represented by the following general formula (F):

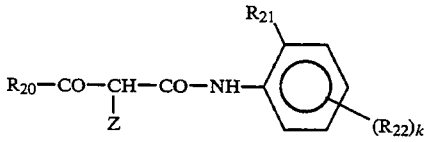

(F)

wherein $R_{20}$ represents a tertiary alkyl group; $R_{21}$ represents a hydrogen atom, a halogen atom, an alkoxy group, an aryloxy group, an alkyl group or a dialkylamino group; $R_{22}$ represents a substituent group capable of being attached to the benzene ring; Z represents a hydrogen atom or a releasing group which is capable of being released by the coupling reaction with an oxidation product of an aromatic amine developing agent; and k represents an integer of 0 to 4, and when k is 2 or greater, two or more $R_{22}$ groups may be the same or different.

2. The silver halide color photographic material of claim 1, wherein the phenyl group and the heterocyclic group represented by Y may be substituted with the substituent groups selected from the group consisting of a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group and an alkyl group.

3. The silver halide color photographic material of claim 1, wherein the heterocyclic group represented by Y, is a 3—to 12-membered, saturated or unsaturated, substituted or unsubstituted, monocyclic or condensed ring heterocyclic group having 1 to 20 carbon atoms, and at least one hetero atom is a nitrogen atom, an oxygen atom or a sulfur atom.

4. A silver halide color photographic material comprising a support having thereon at least one blue-sensitive silver halide emulsion layer, wherein said blue-sensitive silver halide emulsion layer contains at least one yellow dye-forming coupler of the following general formula (2):

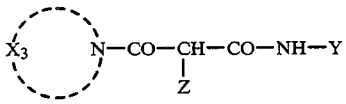

(2)

wherein $X_3$ represents an organic residue which forms a nitrogen-containing heterocyclic group together with >N—; Y represents a phenyl group having at least one substituent group at the orthoposition; and Z represents a group which is a 5—or 6-membered nitrogen-containing heterocyclic group which is bonded at the coupling position through a nitrogen atom, or a 5—or 6-membered heterocyclic thio group; and at least one yellow dye forming coupler represented by the following general formula (F):

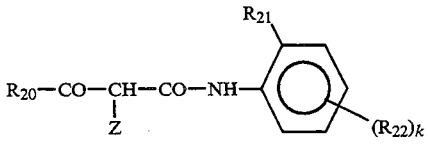

(F)

wherein $R_{20}$ represents a tertiary alkyl group; $R_{21}$ represents a hydrogen atom, a halogen atom, an alkoxy group, an aryloxy group, an alkyl group or a dialkylamino group; $R_{22}$ represents a substituent group capable of being attached to the benzene ring; Z represents a hydrogen atom or a releasing group which is capable of being released by the coupling reaction with an oxidation product of an aromatic amine developing agent; and k represents an integer of 0 to 4, and when k is 2 or greater, two or more $R_{22}$ groups may be the same or different.

5. The silver halide color photographic material of claim 1, wherein when $X_3$ together with >N—forms a nitrogen containing heterocyclic group, the heterocyclic group is a 3- to 12- membered, substituted or unsubstituted, saturated or unsaturated, monocyclic or condensed ring heterocyclic group having 1 to 20 carbon atoms and contains another hetero-atom selected from the group consisting of an oxygen atom and a sulfur atom in addition to the nitrogen atom.

6. The silver halide color photographic material of claim 1, wherein the phenyl group represented by Y in general formula (2) is a substituted phenyl group having 6 to 20 carbon atoms.

7. The silver halide color photographic material of claim 1, wherein the phenyl group represented by Y may be substituted with the substituent groups selected from the group consisting of a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, and N-sulfonylcarbamoyl group, a sulfonamido group and an alkyl group.

8. The silver halide color photographic material of claim 1, wherein the couplers represented by general formula (2) are compounds represented by the following general formula (4) or (5);

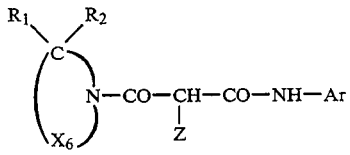

(4)

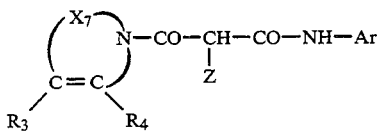

(5)

wherein Z is as defined above in general formula (2); Ar represents a phenyl group having at least one substituent group at the ortho-position; $X_6$ represents an organic residue which forms a nitrogen-containing monocyclic ring or condensed ring heterocyclic group together with $—C(R_1R_2)—N<$; $X_7$ represents an organic residue which forms a nitrogen-containing monocyclic ring or condensed ring heterocyclic group together with $—C(R_3)=C(R_4)—N<$; and $R_1$, $R_2$, $R_3$ and $R_4$ each represents a hydrogen atom or a substituent group.

9. The silver halide color photographic material of claim 8, wherein the couplers represented by general formula (2) are non-diffusible couplers.

10. The silver halide color photographic material of claim 8, wherein the yellow couplers of general formula (2) are present in the range of 1.0 to $1.0\times10^{-3}$ mol per mol of silver halide.

* * * * *